US005765707A

United States Patent [19]

Kenevan

[11] Patent Number: 5,765,707

[45] Date of Patent: Jun. 16, 1998

[54] MODULAR SHIPPING CONTAINER

[76] Inventor: Timothy Paul Kenevan, 3650 Ridgewood Rd., Willits, Calif. 95490

[21] Appl. No.: 436,710

[22] Filed: May 8, 1995

Related U.S. Application Data

[63] Continuation-in-part of Ser. No. 86,726, Jul. 2, 1993, Pat. No. 5,413,236.

[51] Int. Cl.[6] ..... B65D 6/24

[52] U.S. Cl. ..... 220/4.28; 220/4.33; 220/4.31; 220/683

[58] Field of Search ..... 220/4.28, 4.31, 220/683, 23.4, 23.83, 23.86; 206/504

[56] References Cited

U.S. PATENT DOCUMENTS

| | | | |
|---|---|---|---|
| 2,549,509 | 4/1951 | Munroe . | |
| 3,144,951 | 8/1964 | Knabe . | |
| 3,266,656 | 8/1966 | Kridle | 220/4.28 |
| 3,692,201 | 9/1972 | Garduna . | |
| 3,796,339 | 3/1974 | Suzuki . | |
| 4,228,897 | 10/1980 | Underwood . | |
| 4,253,570 | 3/1981 | O'Connor et al. . | |
| 4,703,866 | 11/1987 | Scott . | |
| 5,279,436 | 1/1994 | Elliott et al. . | |
| 5,413,326 | 5/1995 | Kenevan | 220/4.28 |
| 5,529,199 | 6/1996 | Foster | 220/4.28 |

FOREIGN PATENT DOCUMENTS

| | | | |
|---|---|---|---|
| 257562 | 5/1963 | Australia | 220/4.28 |
| 96794 | 11/1922 | Switzerland | 220/4.28 |

OTHER PUBLICATIONS

1992 Thomas Register: Register 4623/p. 11; Record 12037/p. 13; Record or Page 18686/PAL (PAL/18686); Record or Page 18689/PAL; Record or Page 18699/PAL; Record or Page 18700/PAL (PAL/18700); Record or Page 18701/PAL; Record or Page 6218/CON (CON/6218); Record or Page 6228/CON (CON/6228); Record of Page 6230/CON (CON/6230); Record or Page 6273/CON; Record or Page 6281/CON; Record or Page 6285/CON; Record or Page 6288/CON (CON/6288); Record or Page 6289/CON; Record or Page 6296/CON (CON/6296); Record or Page 6972. [17 Records Total, 18 Sheets of Paper].

*Primary Examiner*—Stephen J. Castellano

[57] ABSTRACT

A modular container for use in shipping is disclosed. The container includes a floor element, a plurality of upstanding frame members which are positioned about the floor element, and a plurality of wall panels. The wall panels are associated with the frame members to form the sidewalls of the container. A cover is positioned atop the frame members. The floor element is fitted with tab extensions and recess openings which facilitate the interlocking of a plurality of floor elements to form a floor element assembly. Likewise, the cover is fitted with tab extensions and recess openings which facilitate the interlocking of a plurality of covers to form a cover assembly. The container is includes a strap arrangement which permits the floor element and the cover to be urged into abutment against the frame elements and the wall panels thereby forming a container. The invention discloses a structure for interconnecting a plurality of floor elements, covers, frame elements and wall panels to form a variety of dimensionally unique containers adapted for storing articles of varied dimensions.

3 Claims, 25 Drawing Sheets

MODULAR SHIPPING CONTAINER

This application is a continuation-in-part of application Ser. No. 08/086,726 filed on Jul. 2, 1993, now U.S. Pat. No. 5,413,236.

BACKGROUND OF THE INVENTION

1. Field of the Invention

This invention relates to the field of cargo transport. More specifically, the invention is directed to modular containers for use in facilitating the shipment of cargo by conventional truck trailers.

2. State of the Art

A significant portion of the cargo transported by conventional truck trailers is carried on behalf of shippers whose individual shipments require less carrying capacity than that afforded by an entire empty truck trailer. These types of shipments are known in the trade as "less than truckload" or "LTL" shipments.

Several substantial problems are created in the efficient handling of LTL freight shipments. Due to the logistics of handling these types of shipments, any particular shipment is oftentimes transferred several times from trailer to trailer before the shipment eventually reaches its destination. The multiple times which the shipment is handled not only creates significant labor costs, but furthermore such handling frequently results in damage or loss to the shipment. Billing errors which arise from misclassification of the shipment are another problem associated with the present methods of handling these types of shipments.

The costs associated with warehousing the shipment until it can be transferred to the next trailer also creates a significant overhead for handling these types of shipments. Furthermore, due to the odd sizes of many shipments of this type, it is also difficult to efficiently load a truck trailer to efficiently utilize the entire cargo space of the trailer.

There exists a need for container structures which are adapted for compartmentalizing LTL-type shipments so as to address the problems outlined above.

SUMMARY

The instant invention provides a container formed of a floor element, a plurality of frame elements in association with a plurality of wall panels, and a cover. The various structural members of the container are configured to permit their ready disassembly, whereby the container may be disassembled into a number of component parts adapted for storage in a spatial area which is considerably smaller than that occupied by the assembled container.

The structural members of the container are configured to permit their assembly into containers having various storage capacities. This feature permits the user to utilize the structural members for constructing containers individually sized to encase shipments having various configurations and dimensions.

The floor elements and post elements of the invention may be adapted to include interconnecting means suitable for detachably interconnecting two or more floor elements to one another to form a floor element assembly having an increased dimensional surface area. The covers may likewise include such interconnecting means adapted to facilitate the detachable interconnection of multiple covers to one another to form a cover assembly having increased dimensions. In one embodiment the interconnecting means may take the form of interlocking tabs in association with recess openings.

The frame elements are configured to be detachably coupled with a floor element and a cover to interconnect the floor element with a respective cover. Furthermore, the frame elements may be adapted to interconnect multiple containers together. In those container constructions which include multiple floor elements and covers, multiple frame elements can be used to interconnect a floor element assembly with a cover assembly.

The container may be provided with a compression means adapted for urging the floor element and the cover into abutment against the frame elements and wall panels positioned therebetween. This results in the creation of a compression bond or joint between the floor elements, the cover and the associated frame elements and wall panels. It should be understood that likewise in those constructions which utilize a floor element assembly and cover assembly, such a compression means may also be used.

In one construction this compression means may include the use of a strap which is trained about the perimeter of the container. In these constructions, the floor elements and the covers may be provided with a number of slotted openings which are oriented to permit the user to position a strap or straps about the assembled container. This strap may be used as a means of providing security to the container. In one embodiment this strap may be positioned, generally in a vertical plane, about the container so as to urge the cover and floor element into abutment, i.e. into compression, against the frame members interposed therebetween to thereby provide a secured configuration.

The container may also include an auxiliary strap arrangement disposed laterally about the sidewall defined perimeter of the container. This auxiliary strap arrangement provides a degree of structural integrity to the container by urging the frame members into abutment against the wall panels.

In another construction the floor of the container may contain one or more channels which communicate with the edge of the floor. These channels may include a bottom surface which is inclined. The first end of the channel which is positioned to communicate with the edge of the floor is elevationally lower than the upper surface of the floor. The opposing end of the channel merges with the upper surface of the floor at a location spatially removed from the edge of the floor.

DETAILED DESCRIPTION OF THE ILLUSTRATED EMBODIMENTS

Figure 1:
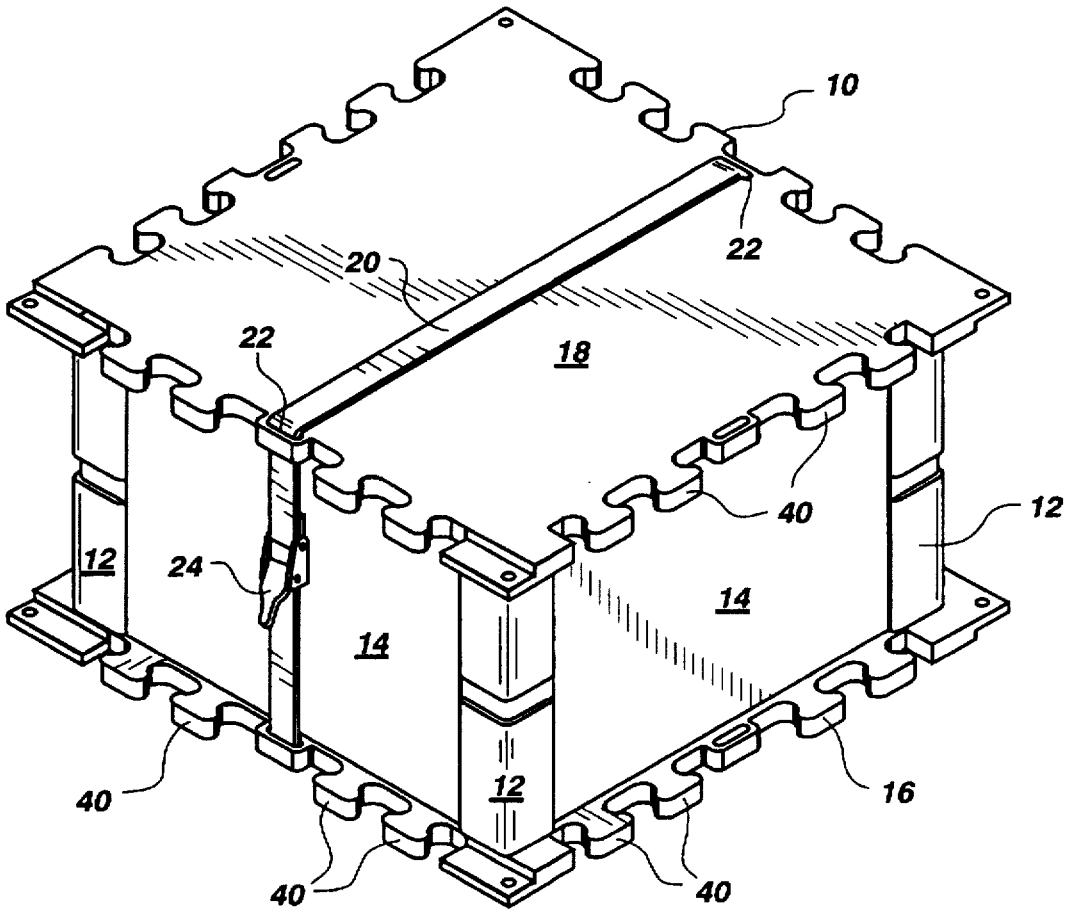
FIG. 1 is an elevated perspective view of a container structure of the instant invention.

As shown in FIG. 1, a container 10 of the instant invention includes a plurality of upstanding frame members 12 which are disposed spacedly from one another to define generally the corners of a quadrilateral. Each container 10 also includes a plurality of wall panel members 14. Each wall panel member 14 is disposed between a pair of adjacent upstanding frame members 12. The floor element 16 of the container 10 is formed by a generally planar element. A cover 18 is positioned atop the frame members 12 and wall panels 14 to enclose the interior of the container 10.

Each of the various elements of the container 10 namely frame members 12, wall panels 14, floor element 16 and cover 18 is adapted and otherwise configured to interact with its adjacent elements to form a detachably interlocked construction. As shown in FIG. 1, the cover 18 defines a plurality of slots 22. Each slot 22 is positioned in a respective side portion of the cover 18. Each slot 22 extends through the complete thickness of the cover 18 and is configured to permit the passage therethrough of a cable or strap 20. Likewise the floor element 16 also defines a plurality of slots 22 within its particular structure. The respective slots 22 in both the cover 18 and the floor element 16 are so configured that when the respective cover 18 and floor 16 are positioned on the container 10 itself, the slots 22 in the respective cover 18 and floor element 16 are aligned one with another so as to permit a passage therethrough of the cable or strap 20. As further shown in FIG. 1, these slots are so aligned so as to permit the user to position the cable or strap about the central portion of the container structure so as to encircle the entire container structure. The cable or strap 20 is therefore oriented in a generally vertical plane. A clamping and locking structure of a type well-known in the cable and strap art is affixed to one of the ends of the cable or strap 20 thereby permitting the user to interconnect the opposing ends of the cable or strap and tension the cable or strap about the container structure so as to provide some structural integrity especially in a vertical direction to the container. The cable or strap 20 functions to urge the cover 18 and the floor element 16 into abutment against either the frame members 12 or the wall panels 14 or both.

Figure 2:
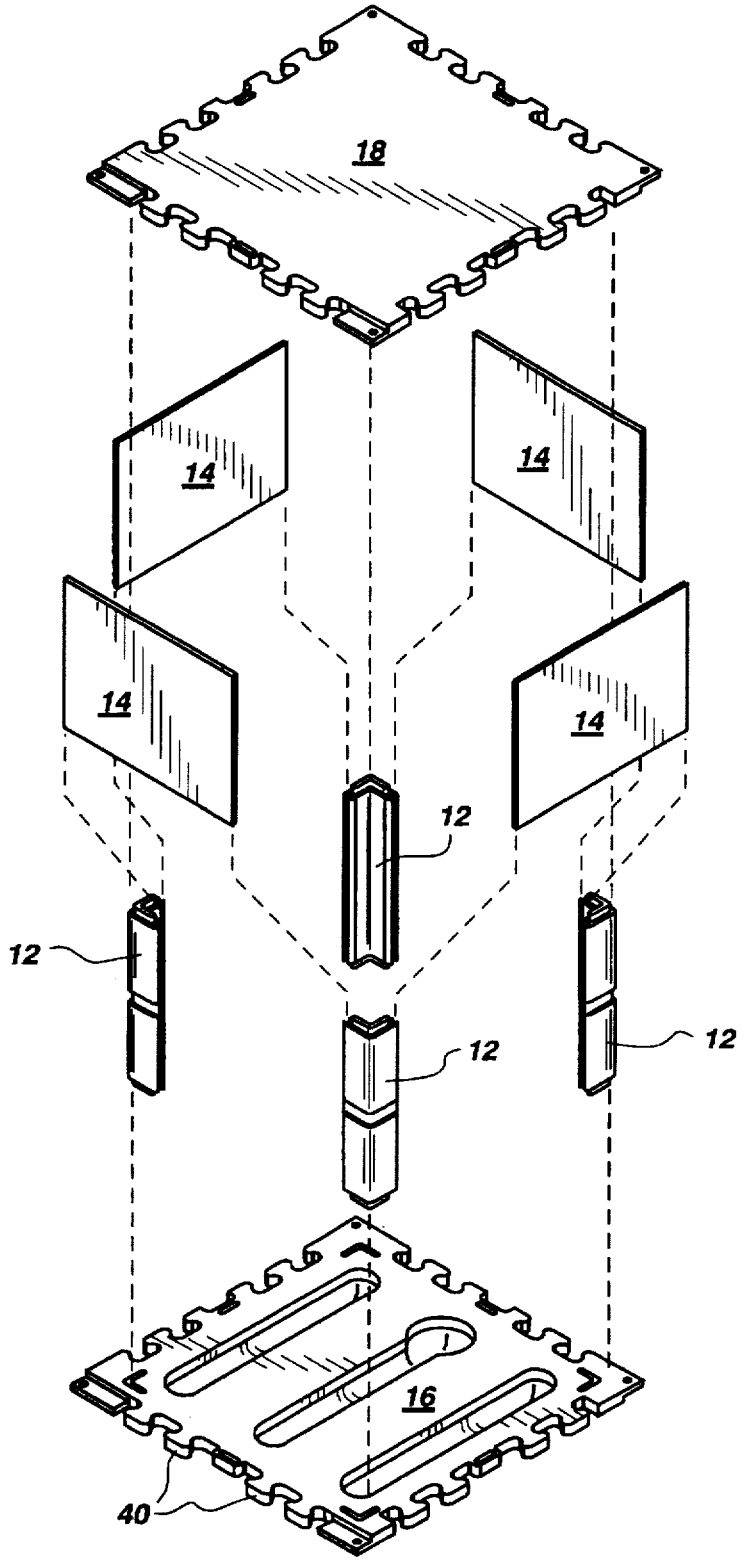
FIG. 2 is an exploded view of the container structure of FIG. 1, wherein the retainer strap has been removed for clarity.
Figure 3A:
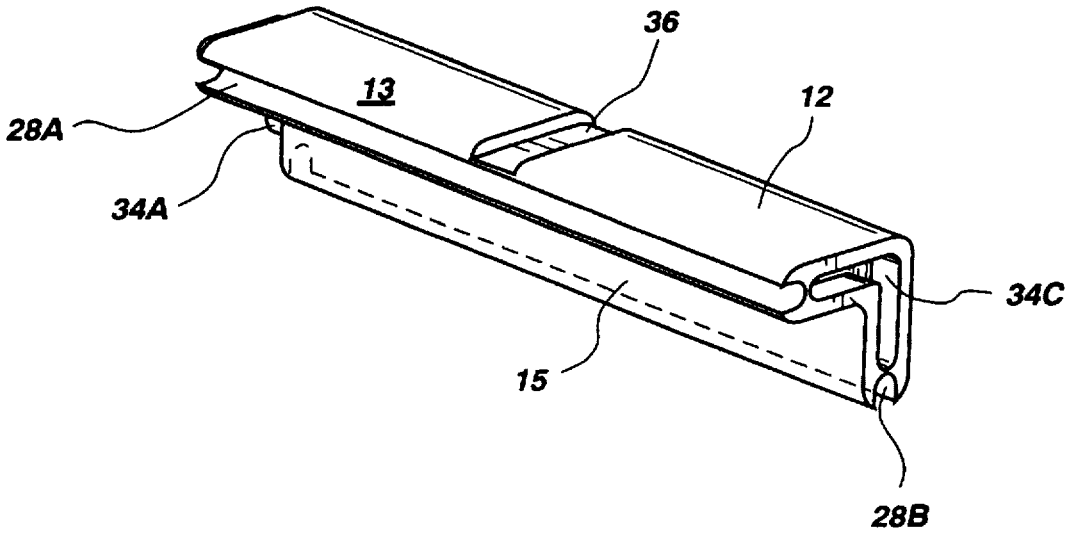
FIG. 3A is an elevated view of an alternative embodiment of an upstanding frame member of the container structure.
Figure 4:
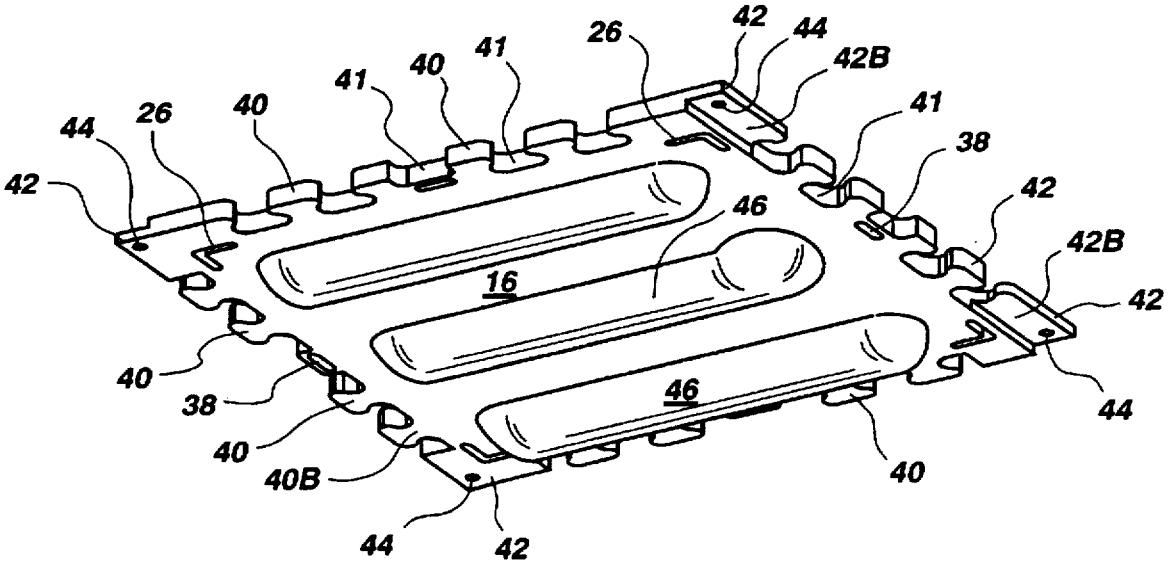
FIG. 4 is a bottom view of a floor element of the invention.

FIG. 2 illustrates an exploded view of the container structure of FIG. 1. As shown, the floor element 16 is formed of a generally quadrilaterally-perimetered, planar element having a generally constant thickness over its surface. As further illustrated in FIGS. 5 and 6, the floor element 16 includes on each of its sides or edges, a plurality of tab shaped members 40 which are configured to extent laterally outward away from the general structure of the floor element 16. As illustrated in FIG. 4, each of these tab shaped members 40 includes a generally elongated region at its end which then tapers to form a neck 40B. The neck is interconnected to the general structure of the floor element 16. Each of the tab members 40 is separated spatially from its adjacent tab elements 40 so as to define a opening 41 therebetween. Each of the openings 41 are configured specifically so as to receive a tab element 40 of an adjacently positioned floor element 16. As shown to advantage in FIG. 6, when adjacent floor elements 16 are positioned contiguous to each other the respective tab members 40 of one floor element 16 are received within the corresponding openings 41 of the adjacent floor element 16. Due to the particular configuration and orientation of the tab members 40 and their corresponding openings 41 in the adjacent floor element 16, the positioning of one floor element 16 contiguous to a second floor element 16 permits a interlocking of the respective tabs and corresponding openings of the two floor elements 16. The two floor elements together form a floor element assembly. It should be understood that a number of floor elements may be interconnected one to another to form a floor element assembly having one of a number of different dimensions. This interlocking function thereby provides a means whereby a plurality of floor elements may be structurally interconnected one to another laterally.

Figure 5:
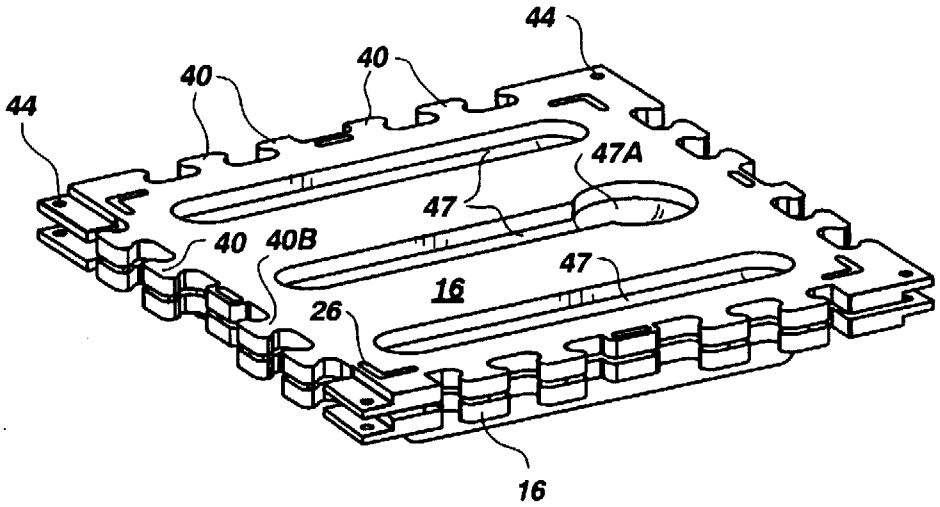
FIG. 5 is an elevated perspective view of two floor elements of a container structure, the floor elements being nested in one another.
Figure 6:
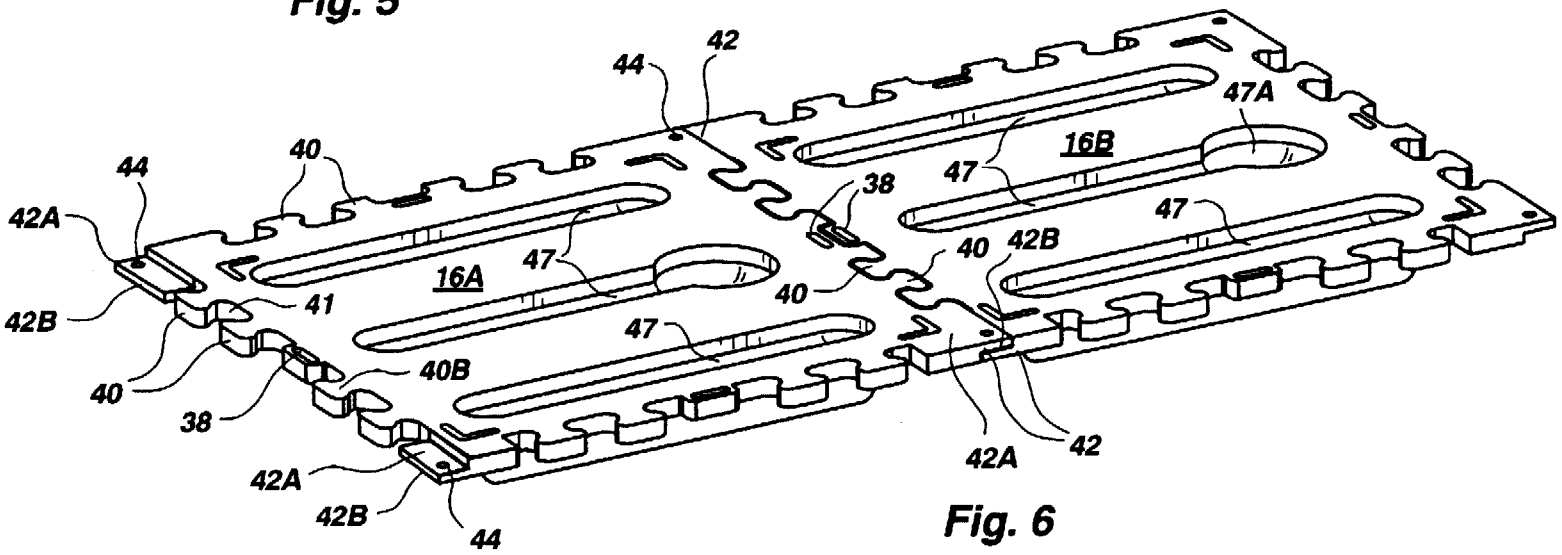
FIG. 6 is a pair of floor elements of the instant invention shown in an interlocked configuration on one of their lateral edges.

On each end of each side of the floor element 16 is positioned a lateral extension 42. As illustrated in FIGS. 4, 5 and 6, each extension 42 is dimensioned to be approximately one half of the thickness of its respective floor element. Defined within the body of each extension 42 is an opening 44 which extends through the complete thickness of the floor element 16. The purpose and function of the openings 44 will be explained later. As illustrated, each of the extensions 42 are configured to have a thickness which is preferably approximately one-half of the thickness of the floor element 16. The particular construction of each extension 42 may vary about the perimeter of each floor element 16.

In one preferred construction as shown in FIG. 6, the top surface of the extension 42 is oriented parallel and co-planar with the top surface of the floor element 16A. Whereas the bottom surface 42B is positioned parallel but not coplanar with the general planar surface of the bottom of floor element 16A. The structure of the extensions 42 on a floor element 16B, which may be positioned contiguous to its adjacent floor element 16A, is generally opposite to that previously described for the extension 42 of floor element 16A, i.e., the top surface of the extension 42 of the floor element 16B is not coplanar with the top surface of the floor element 16B, whereas the bottom surface of the extension 42 of the floor element 16B is co-planar with the bottom surface of the floor element 16B.

These particular constructions of the extensions 42 permit an interlocking of the respective extensions when the two floor elements 16A and 16B are brought into an interlocking relationship. As shown in FIG. 6 as each of the extensions 42 are brought into an interlocking relationship, the extension 42 of the floor element 16A slides over and above the extension 42 of the floor element 16B. The respective openings 44 in each of the extensions 42 are so configured that when the floor elements 16A and 16B are brought into an interlocking relationship the openings 44 are aligned thereby defining a vertically extending continuous channel which extends through the complete thickness of the two overlapped extensions 42A and 42B.

The floor element 16 defines a plurality of downwardly-directed, generally semi-circular structures 46. While the structures 46 are illustrated as being semicircular in configuration, it should be understood that the structures could also be of other configurations which are not semi-circular. Each of these structures are configured to form a support for the floor element 16 for purposes of supporting the container on an underlying surface such as a floor or the ground. In the preferred construction shown in FIGS. 5 and 6, each of the extensions 46 are configured to have a semi-circular bottom 46A. As seen in FIGS. 5 and 6, the top surface of the floor element 16 defines a plurality of elongate open channels or recesses 47 which are positioned spacedly about the surface of the top surface of floor element 16. Each of these open channels corresponds generally to a respective floor extension 46 which extends from the opposing side of the floor element 16. Each of the open channels 47 is configured to receive a corresponding floor extension 46 of a floor element 16 in a nesting relationship. As shown to advantage in FIG. 5 wherein two floor elements 16 have been nested one into the other. It should be recognized that each of the floor extensions 46 of the cover 18 have been received within a corresponding recess 47 defined within the floor element 16. The open channels 47 are dimensioned to receive and store one or more of the frame members 12 when the container has been disassembled. As may be noted in FIGS. 4 and 4A, one of the open channels 47, and its respective extension 46 has been enlarged on one of its ends to form a supplemental storage area which is specifically dimensioned to receive and store the cable or strap 20.

Each floor element 16 also defines a plurality of generally L-shaped slots 26 which are spacedly positioned about the structure of the floor element 16. As shown to advantage in FIGS. 4, 5 and 6, each of these L-shaped slots 26 are positioned proximate a corner of the quadrilaterally-shaped floor element 16. As shown, one leg of the L-shaped slot 26 is positioned to be parallel to its adjacent side of the floor element 16, while the other leg of the slot is positioned to be parallel to the side of the floor element 16, which is adjacent thereto. Each of the slots 26 may be configured to extent either completely through the thickness of the floor element 16 or partially through that thickness. Each of these slots is adapted to receive a flange extension 34 of a respective, upstanding frame member 12. The slots 26 are dimensioned and configured to generally receive and retain a respective frame member 12 in a tight yet detachably secure fashion.

Figure 3:
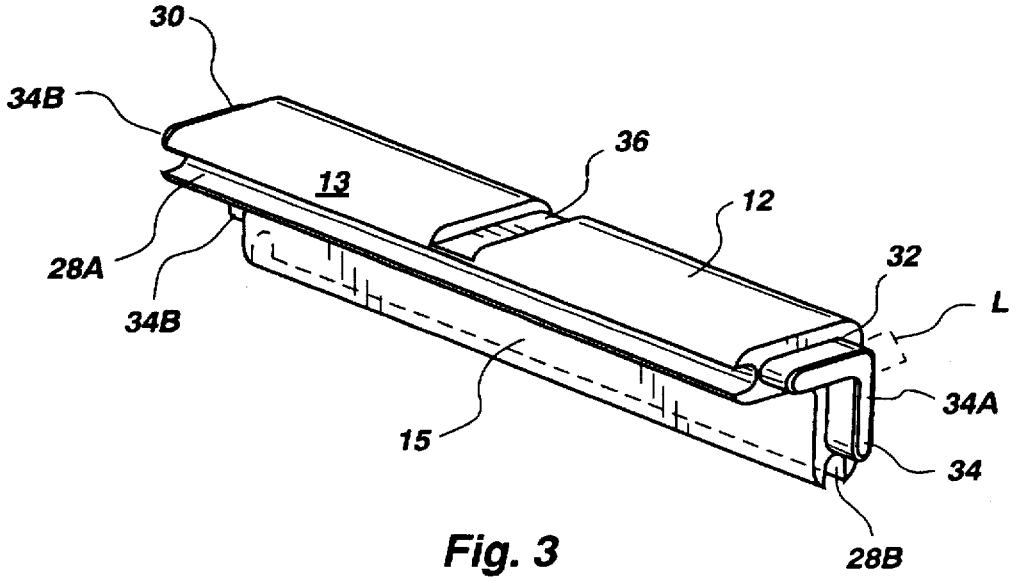
FIG. 3 is an elevated perspective view of an upstanding frame member of the container structure.

As shown in FIG. 3, an upstanding frame member 12 of the instant invention is a generally elongate body having a generally L-shaped cross section. The frame member 12 includes a L-shaped extension 34A positioned on its first end 32; a second L-shaped extension 34B is positioned on the opposing end 30. As shown, each L-shaped extension 34 follows generally the shape and configuration of the cross section of the frame member 12. Extensions 34 are dimensioned to have a length L which may be substantially less than the thickness of its corresponding floor element 16. Alternatively, the length L of the extension 34 may be dimensioned so as to be considerably larger that the thickness of its corresponding floor element 16.

In one construction, each of the frame members 12 is positioned atop its corresponding floor element 16 as shown in FIG. 2 such that each of the extensions 34A extend downwardly into the floor element 16 so as to form a secure and generally rigid interlocking, yet detachable, relationship with the floor element 16. In these particular constructions, the extension 34A may extend either partially or perhaps even completely through the thickness of the floor element 16. It is also contemplated that the length L of the extension 34A may be so configured so as to extend downwardly through the complete thickness of the floor element 16 and furthermore, extend sufficiently beyond the floor element 16 so as to extend beyond the bottom surface 46A of the floor extensions 46. In this later construction, the extensions 34 may actually form feet for the container structure and actually serve as supports for supporting the container 16 above an underlying surface.

FIG. 4A illustrates an alternative construction wherein the second extension of the frame member 12 has been removed and replaced by a correspondingly configured slot 34C. This particular construction is adapted for use in those embodiments wherein one frame member is positioned atop another frame element to form a frame member assembly having an increased dimensional height. In this particular embodiment, the first extension 34A of the upper frame member 12 is inserted into the slot 34C defined on the upper surface of the lower positioned frame member 12. Both the extension 34A and the slot 34C is dimensioned to produce a tight friction fit point adapted to retain the two frame member in a conjoined vertical orientation. This construction is shown to advantage in FIG. 7.

The invention may also utilize a frame member 12 which includes only slots 34C on each of its respective ends. A use of this type of frame member may also include the use of a floor element 16 or cover 18 which defines one or more extensions thereon which structurally correspond to the extensions 34A found on the frame members 12 previously described. The interconnection of the frame members 12 and the corresponding floor elements 16 or covers 18 would be substantially as previously described with the exception that the relative positioning of the extensions and receiving slots would be reversed.

Each frame element 12 defines a pair of channels 28 which extend along one side of each of the respective legs of the L-shaped frame member 12. As shown in FIG. 4, a channel 28A extends along the complete free edge of the leg 13 of the frame 12 whereas a second channel 28B extends along the complete free edge of the leg 15 of the frame member 12. Each of the channels 28A and 28B is formed to have a substantially semi-circular cross section.

Figure 8:
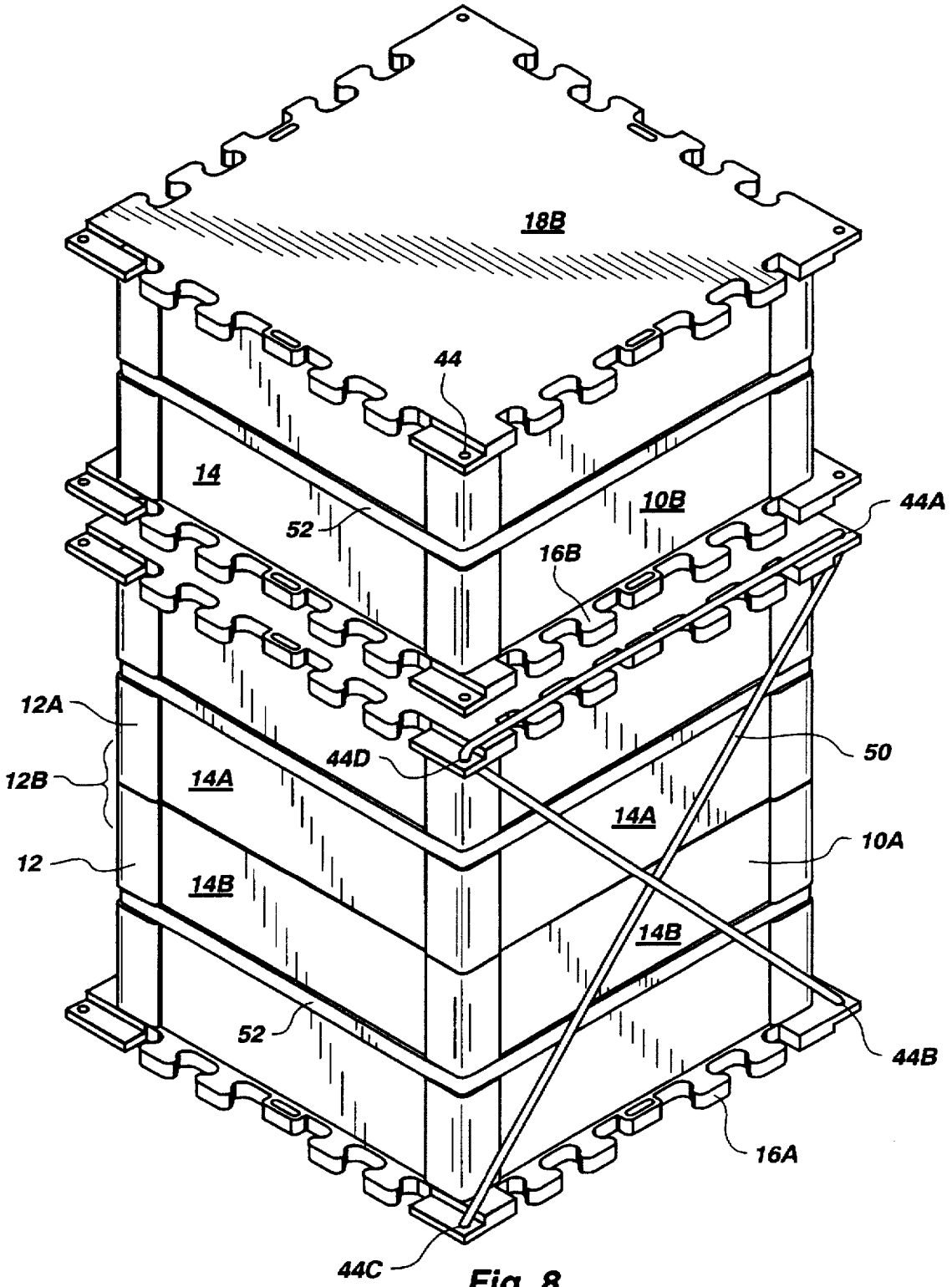
FIG. 8 is another alternative construction of the container of the instant invention wherein a pair of containers are shown interlocked one with another by means of a vertically and horizontally extending cable or strap arrangement.

A channel 36 is defined within each of the legs 13 and 15 of the frame element 12. The channels are interconnected such that they extend in a generally "L" shaped configuration about the exterior surface of the frame member 12. Each of the channels 36 is dimensioned to receive a cable or strap 52. As shown in FIG. 8, a cable or strap 52, corresponding generally to the cable or strap 20 shown in FIG. 1, may be adapted to encircle the exterior of the container 10 and extends in a generally horizontal plane to provide lateral structural integrity to the container 10. As was the case with cable or strap 20, cable or strap 52 may also be fitted on its end with a clasp or locking mechanism adapted to tension and retain the cable or strap 52 in a tension condition about the perimeter of the container 10. The cable or strap 52 is adapted to urge the frame members 12 into abutment with the wall panels 14 interposed therebetween them.

Referring again to FIG. 2, each of the wall panel 14 of the container may be generally planar members having a quadrilateral configuration. Each of the wall panels 14 is dimensioned on its vertical edges to be received into the respective slots 28A and 28B of corresponding upstanding frame members 12. Upon having its edges received within its corresponding frame members 12, each wall panel 14 is held in a generally, upright, vertical orientation to form the side wall of the container 10.

Each cover element 18 is configurationally identical to its corresponding floor element 16, i.e., each cover element 18 includes a plurality of tab members 40 which are positioned spacedly along each of the sides of the cover. Furthermore, each cover element defines a plurality of slots 38 which are positioned on each of the sides of the cover 18 so as to generally be aligned with the corresponding slots 38 in the floor element 16. It should be understood that although the instant description describes a floor element 16 and a cover 18 wherein all of the four sides of each member is fitted with tab members, the invention also embraces constructions wherein only one, two or three sides of the floor element and/or cover is fitted with such tabs.

Each floor element 16 includes a plurality of extension members 46 and corresponding recesses 47. Furthermore, each cover 18 also includes a plurality of L-shaped slots 26 which are positioned about the surface of the cover 18 so as to receive the extensions 34B of each of the upstanding frame members 12.

As shown in FIG. 2, four upstanding frame members 12 are positioned onto the floor element 16 by the insertion of their respective L-shaped flange 34A into respective corresponding L-shaped openings 26 figured within the floor element 16. In this configuration, each of the frame members 12 are positioned in a vertically upstanding orientation. Thereafter, the wall panel elements 14 are positioned within a pair of opposing slots 28 of two adjacent frame members 12 to orient the wall panels 14 in a vertically upright orientation and thereby form a box-like enclosure which extends upwardly from the floor element 16. The cover element 18 is then positioned over and atop the upstanding wall elements 14 so as to position the L-shaped extensions 34B of each of the frame members 12 within respective L-shaped slots 26 defined within the structure of the cover 18. In this particular construction, the floor element 16, frame members 12, wall panels 14 and cover 18 define a generally box-like structure having a hollow interior adapted for receiving and retaining articles to be shipped.

Figure 7:
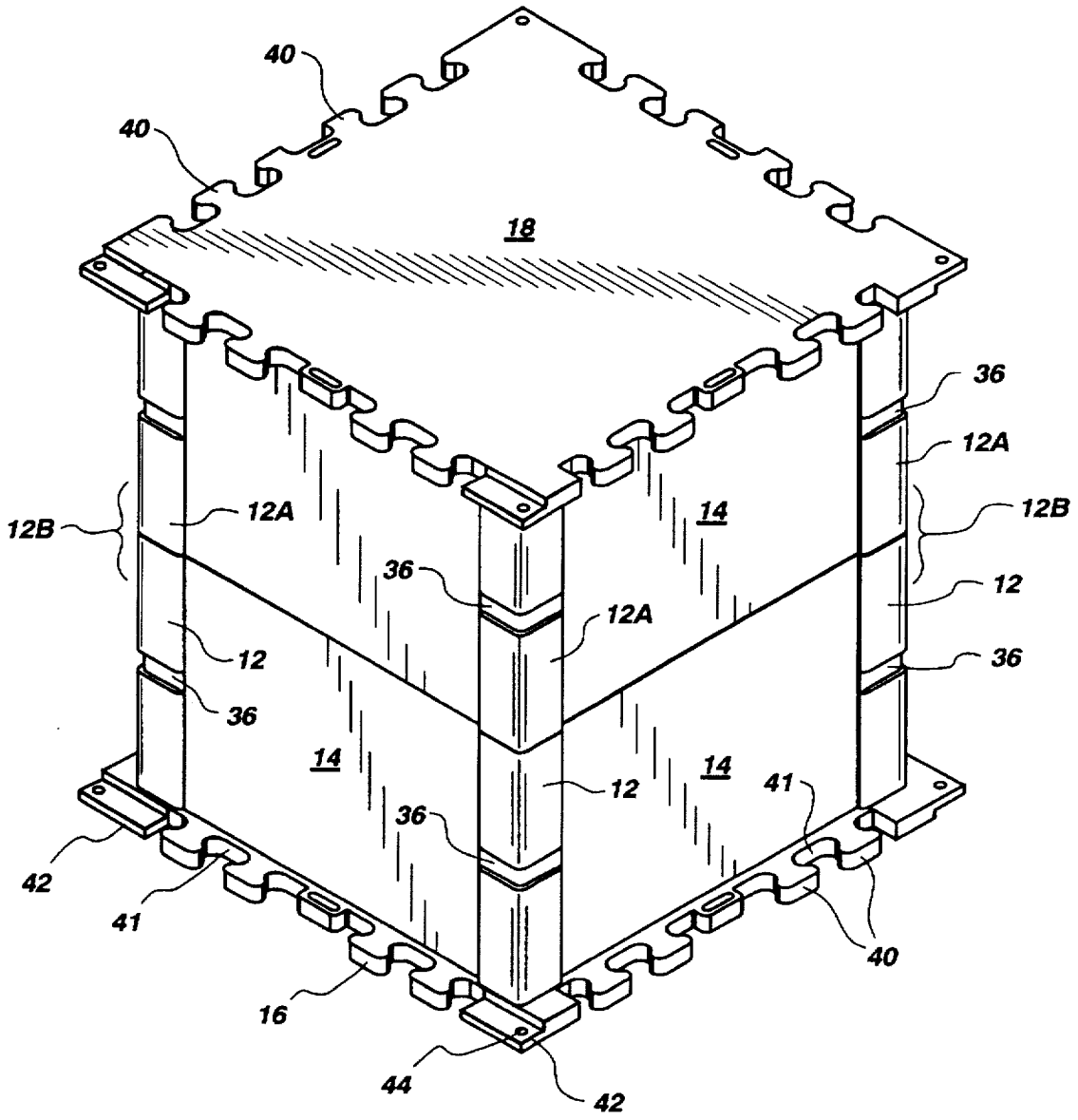
FIG. 7 is an elevated perspective view of a alternative container configuration of the instant invention.

FIG. 7 illustrates an alternative construction wherein the interior volume of the container 10 has been increased by increasing the height of the respective side walls of the container. In this particular construction, a second set of frame members 12A have been positioned atop the first set of frame members 12 to form four augmented frame members 12B. In this construction each of the frame members 12A have been configured to eliminate their extensions 34A. In the place of those extensions, each of the frame members 12A have been configured to define an L-shaped slot therein. Each of the slots has been configured to receive the extension 34B of a respective frame member 12. It follows that upon each of the frame members 12A being positioned atop a respective frame member 12 with the extension 34B of the frame element 12 being inserted into its respective slot within its respective frame member 12A the height of the frame member may be extended or otherwise augmented to a desired height. Thereafter, a pair of wall panels 14 and 14A are inserted into their respective slots 28 of the adjacently positioned, augmented frame member 12B to form the side walls of a container structure. It should be understood that the frame members 12 and the supplementary frame members 12A may be configured in various heights so as to optimize the available cargo carrying space of a trailer in which the containers are to be loaded.

A container 10 may actually be constructed about the shipment so as to correspond generally to the size of that shipment. It is also contemplated that the floor elements, frame members, wall panels and covers may be dimensioned so as to be constructible into containers which are of heights which are readily combinable to equal the interior height of the cargo carrying area of a trailer.

FIG. 8 illustrates a configuration wherein the container of FIG. 1 has been positioned atop the container of FIG. 7. This particular FIG. 8 illustrates a contemplated configuration of containers which have been loaded onto a trailer for purposes of transport. The lower container is fitted with a cable or strap arrangement adapted to add stability in a vertical direction by means of a plurality of cables or straps 50 which have been positioned to pass through the corresponding apertures 44 defined in the respective floor element 16 and cover 18 of the container. As shown, a cable or strap 50A extends through a opening 44A in floor element 16A and thereafter passes through an opening 44B of the cover 18A of container 10A. The cable or strap 50A thereafter passes through an opening 44C in the cover 18A of container 10A. The cable or strap 50A then passes through an opening 44D defined within the floor element 16A of container 10A and thereafter is directed horizontally to a opening 44A also defined within the cover 16A of container 10A. The ends of cable or strap 50A are thereafter secured to one another to form an endless configuration. The ends of the cable or strap may be interconnected with the first end of the cable or strap 50A by means of a clasp or locking mechanism of a type known in the art to facilitate the cable or strap being tensioned about the container.

As further illustrated in FIG. 8, a second cable or strap 50B may also be oriented in a fashion similar to cable 50A about the vertical sides of the container. It should also be understood that these cable or strap arrangements also provide some degree of horizontal, i.e. lateral, stability to the container.

Figure 9:
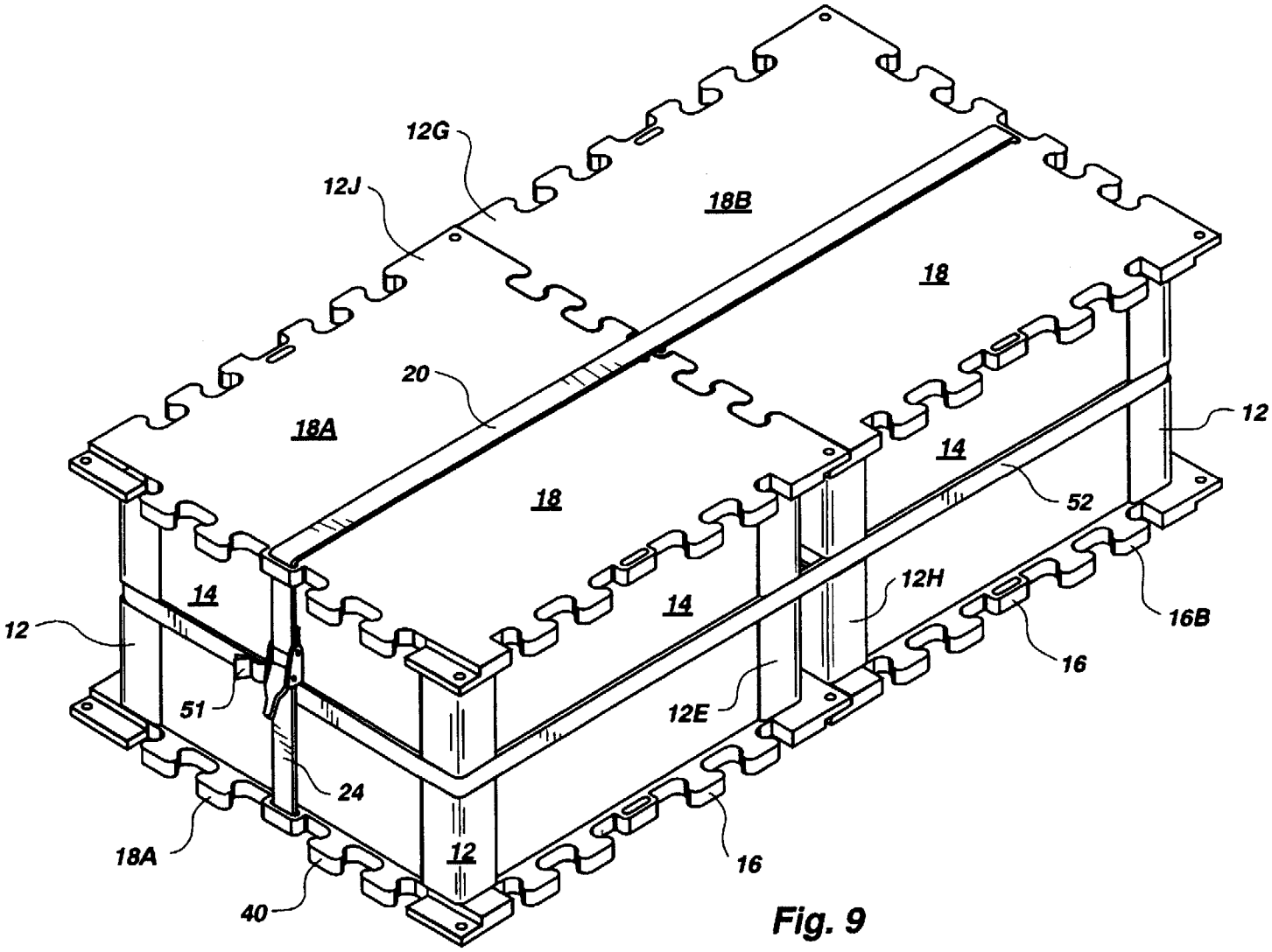
FIG. 9 is an elevated perspective view of an alternative container structure.

FIG. 9 illustrates a construction wherein two floor elements 16 have been interconnected one to another to form a floor element assembly. Further, two covers 18 have been joined along one of their respective edges to form a cover assembly. Eight frame members 12 have been mounted between the cover assembly and the floor member assembly. As shown in part in FIG. 9, a frame member 12 is placed at each corner of the floor element assembly and the cover assembly. Two frame elements are positioned substantially adjacent one another proximate the middle of the elongate sides of the floor element assembly and cover assembly. It should be understood that the middle frame members 12E and 12H are not connected by means of wall panels 14 to the frame elements 12G and 12J which are positioned opposite them on the floor assembly. Instead, the interior of the container structure is free of any wall panels extending through the central region of the hollow interior of the container.

Figure 14:
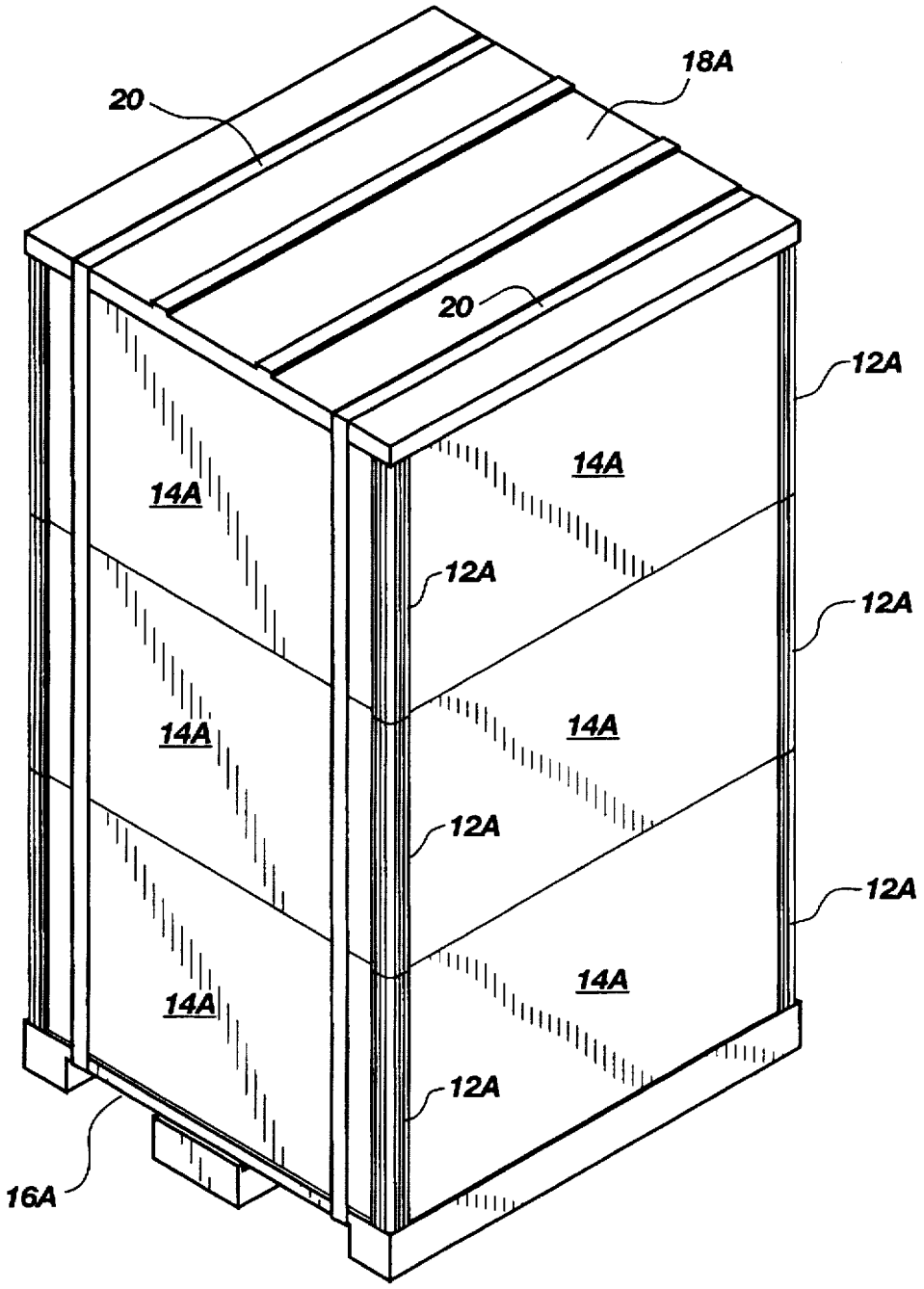
FIG. 14 is an elevated perspective view of an container constructed to have a height approximately three times the standard height of the container shown in FIG. 10.
Figure 15:
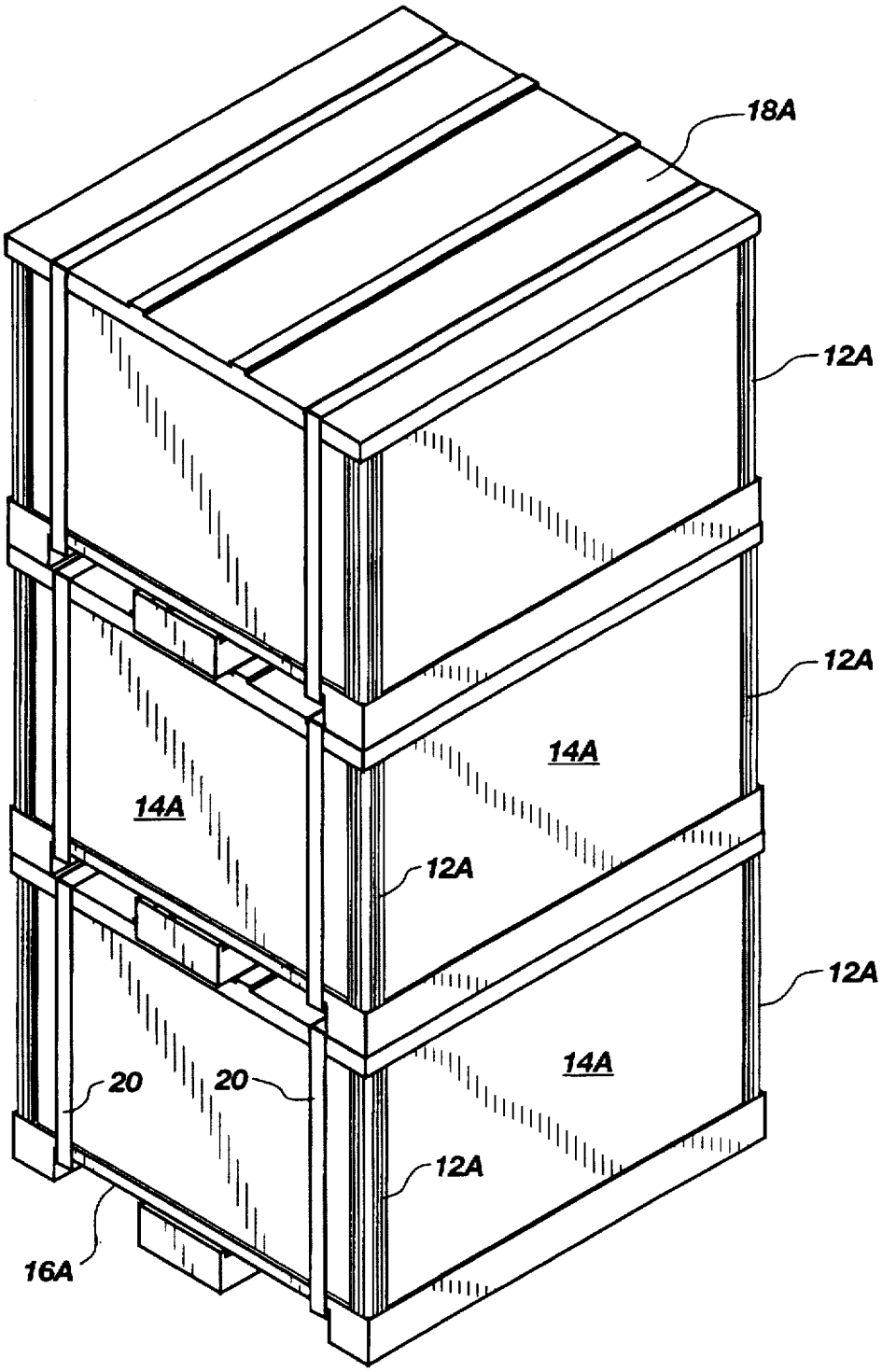
FIG. 15 is a perspective view of three containers positioned one atop another.

This particular construction illustrates just one of the numerous ways in which the floor elements and covers can be assembled into assemblies and then associated with frame elements and panels 14 to form containers having various storage capacities. FIG. 14 illustrates a container having a height which is generally three times the normal height. This particular container was formed by joining three frame members 12 end to end to form a frame member assembly which was three times the normal height. In addition, side panels 14A were positioned one atop another to form a three level assembly of side panels. FIG. 15 illustrates three separate containers which have been placed one atop another.

Figure 10:
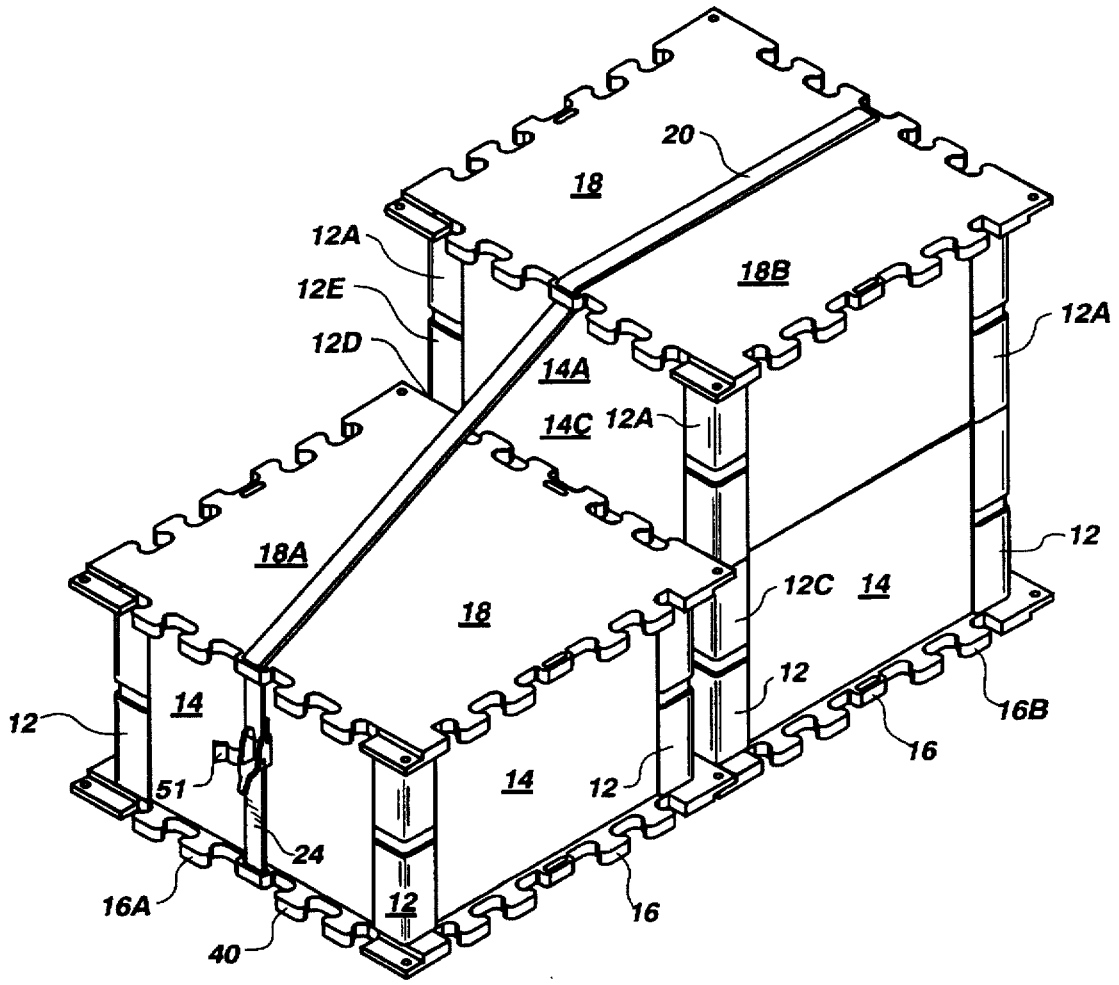
FIG. 10 is an elevated perspective view of a second alternative container structure.

FIG. 10 illustrates a container construction having a substantially "L" shaped configuration when viewed from the side. In this particular construction a second set of frame members 12A have been installed on four of the frame elements 12 in order to increase the height of one half of the container structure. Wall panel elements 14A have been installed between the frame members 12A and a cover 18A has been installed atop the frame members 12A. The wall panel 14C sits atop the cover 18A. No wall panel 14 is positioned between frame element 12C and the frame element 12D which is positioned directly below frame member 12E.

Figure 11:
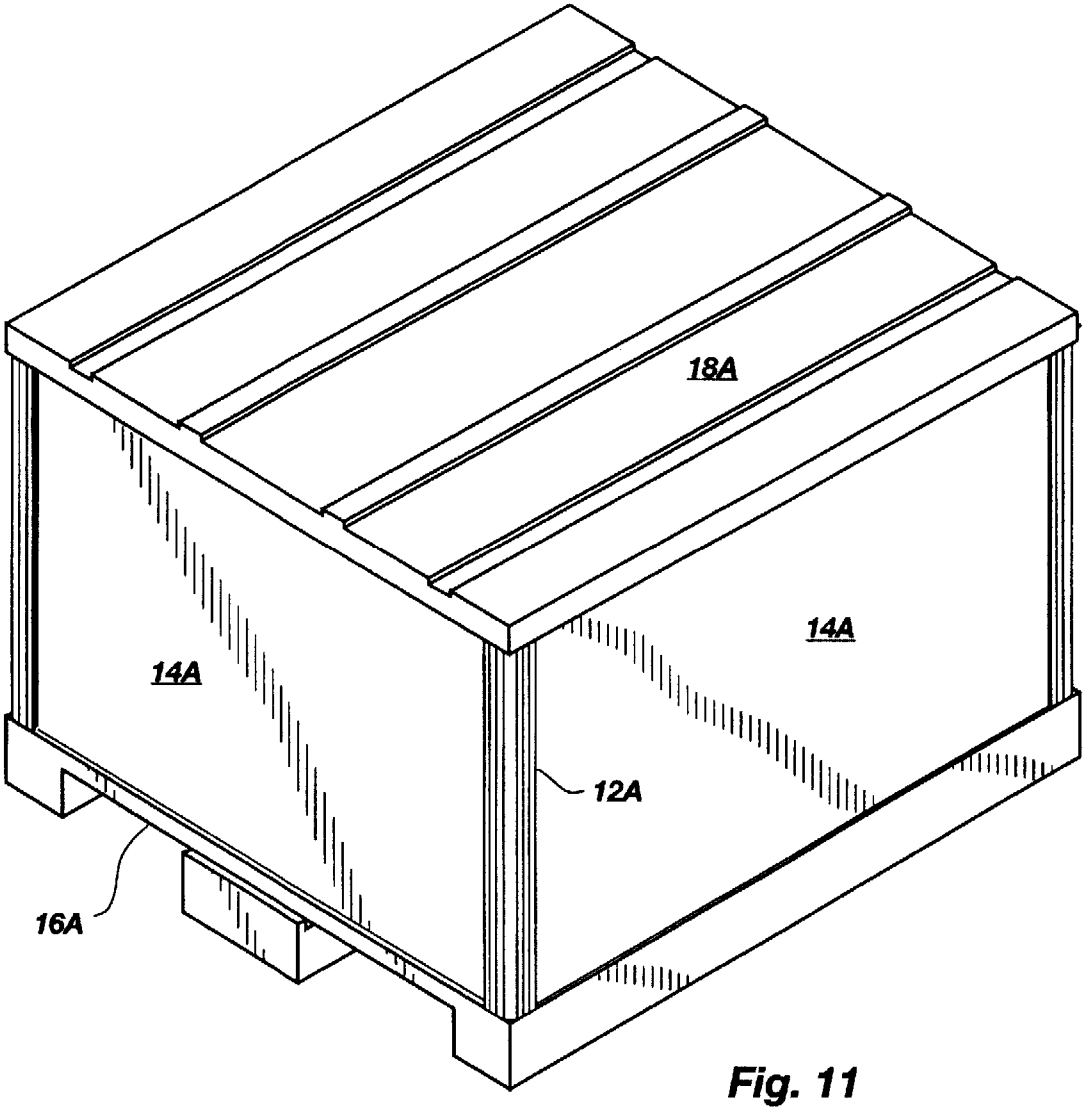
FIG. 11 is an elevated perspective view of another embodiment of the invention illustrated in a constructed condition.
Figure 12:
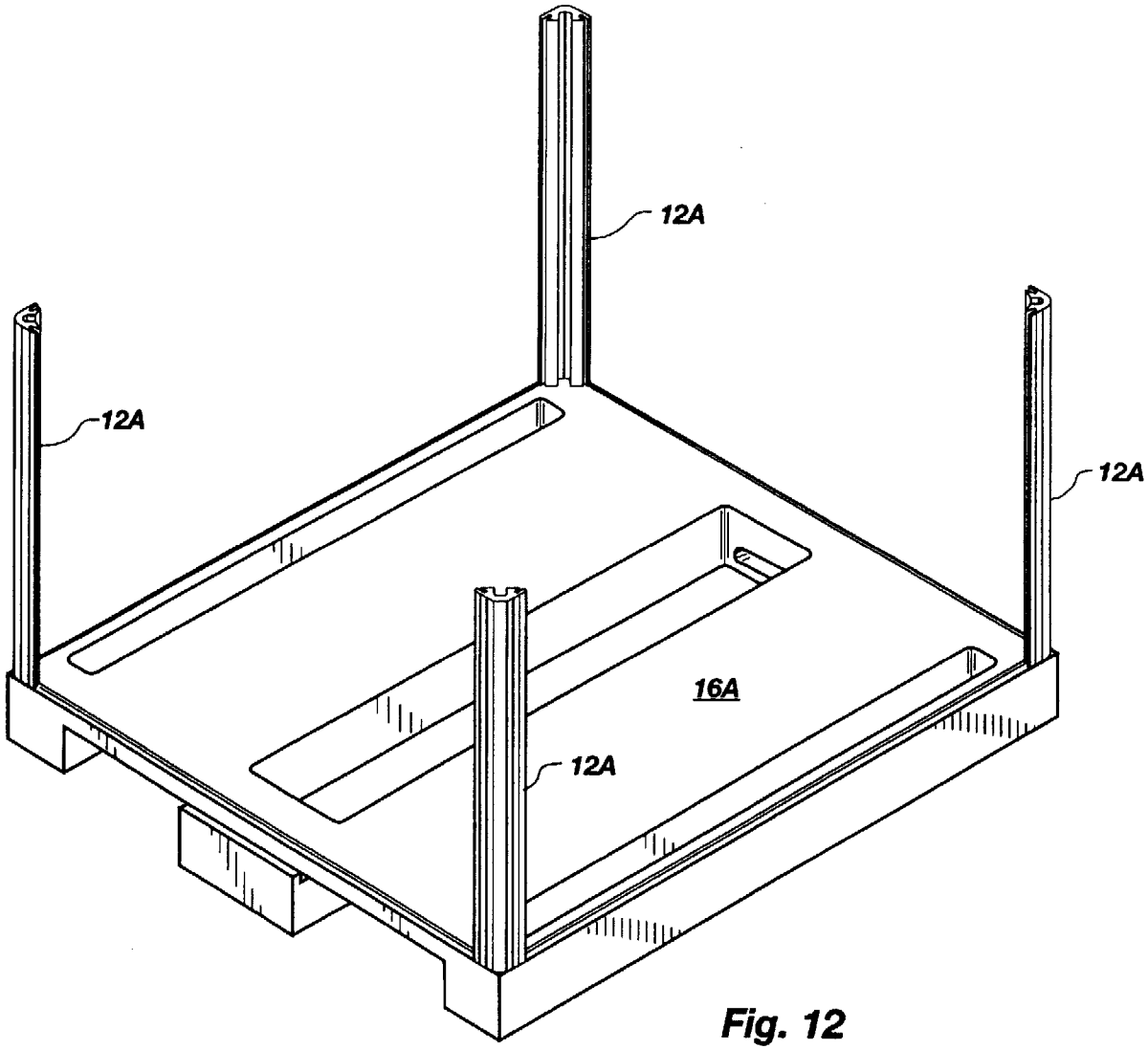
FIG. 12 is an elevated perspective view of the container of FIG. 11 with the cover and sidewalls removed.
Figure 13:
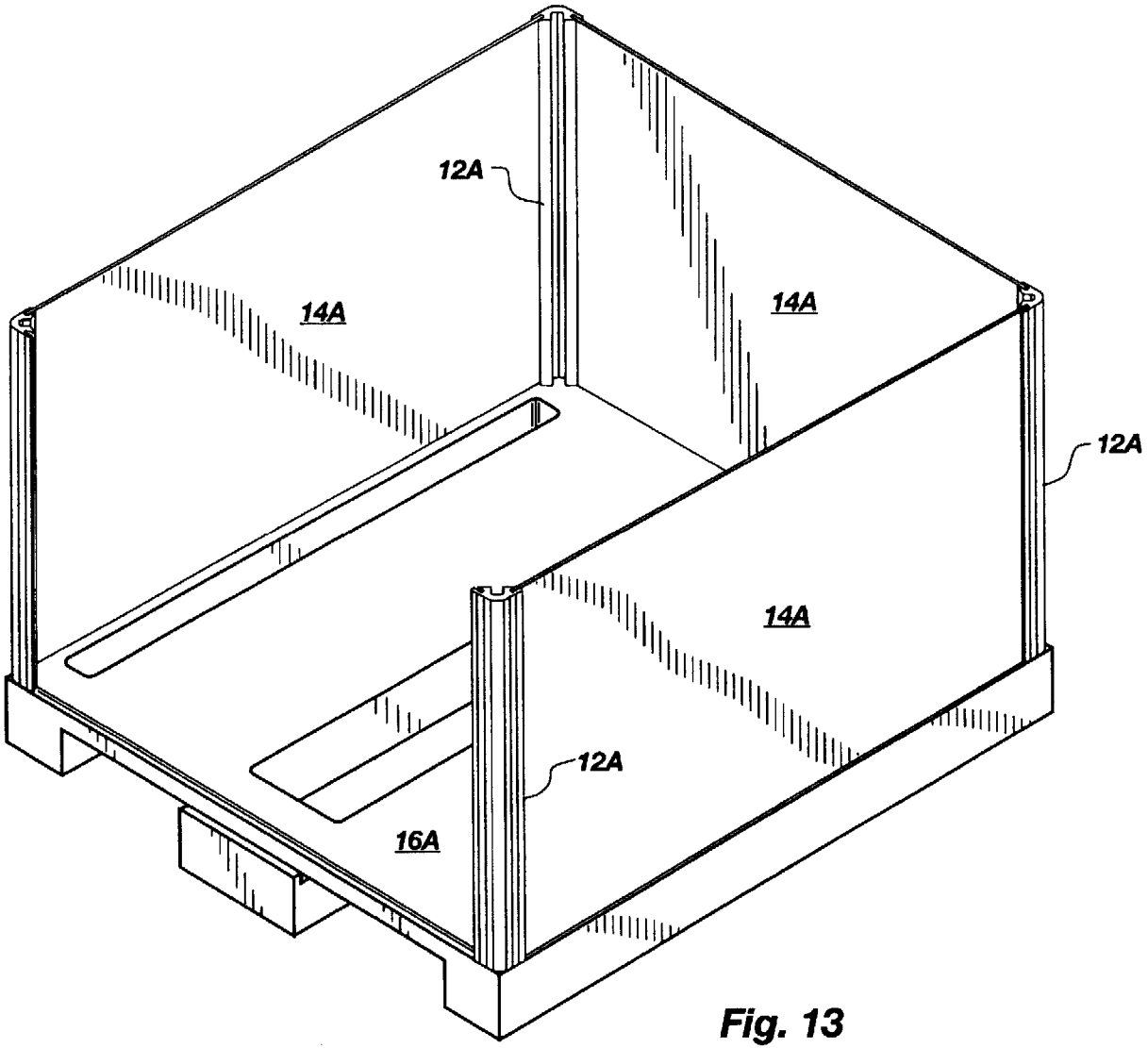
FIG. 13 is an elevated perspective view of the container of FIG. 12 having three of the sidewalls installed.
Figure 22:
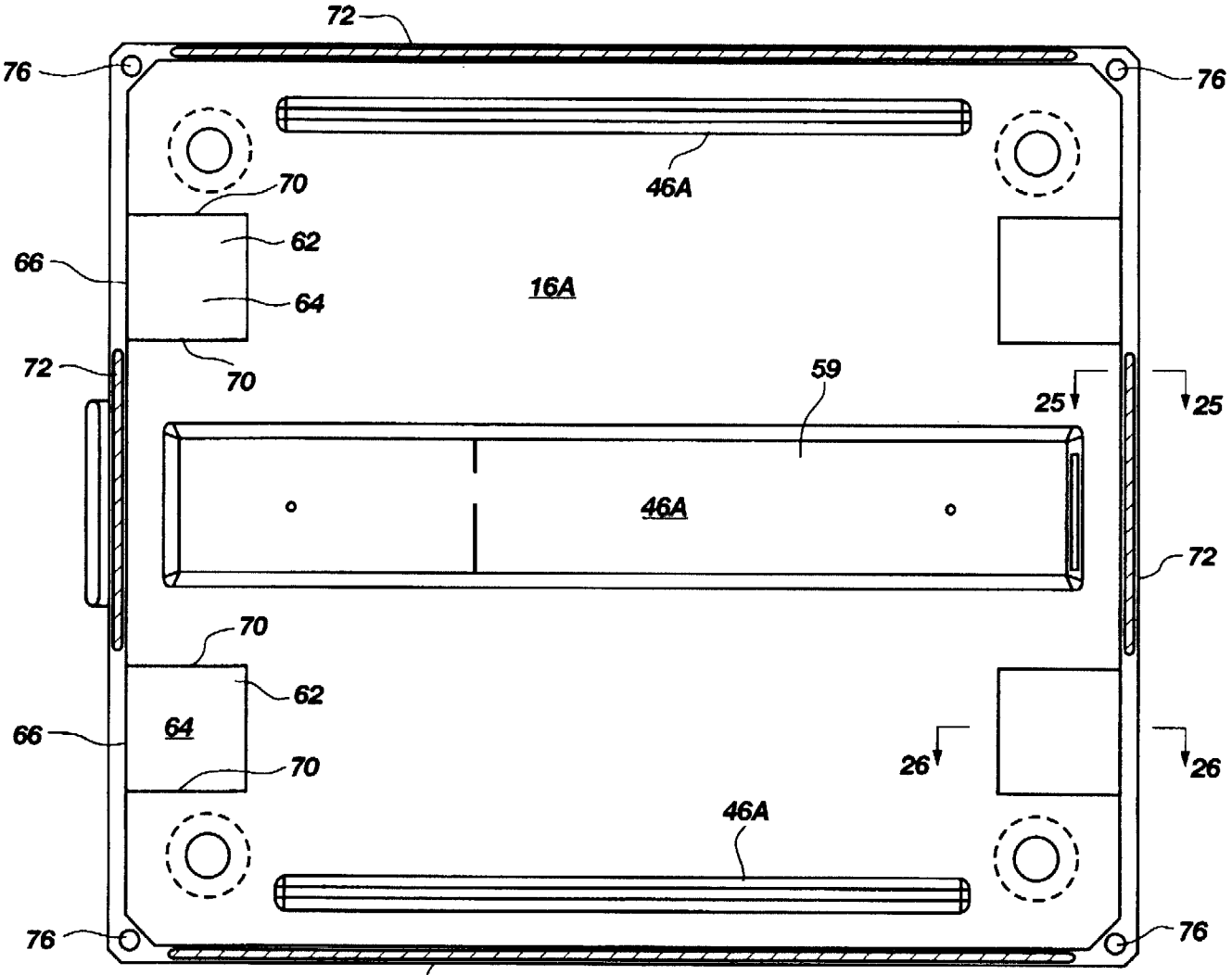
FIG. 22 is a top plan view of the upper surface of the floor of the container of FIG. 11.
Figure 23:
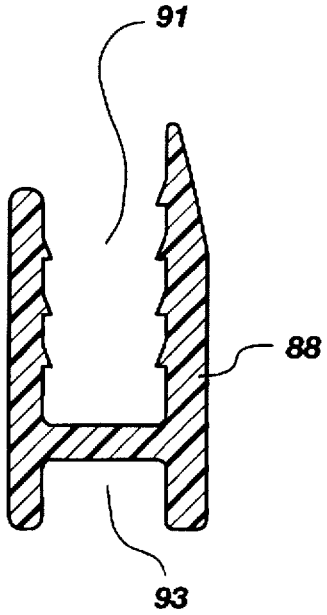
FIG. 23 is an elevational view of a water seal of the invention, the water seal normally being attached to a respective wall panel.
Figure 24:
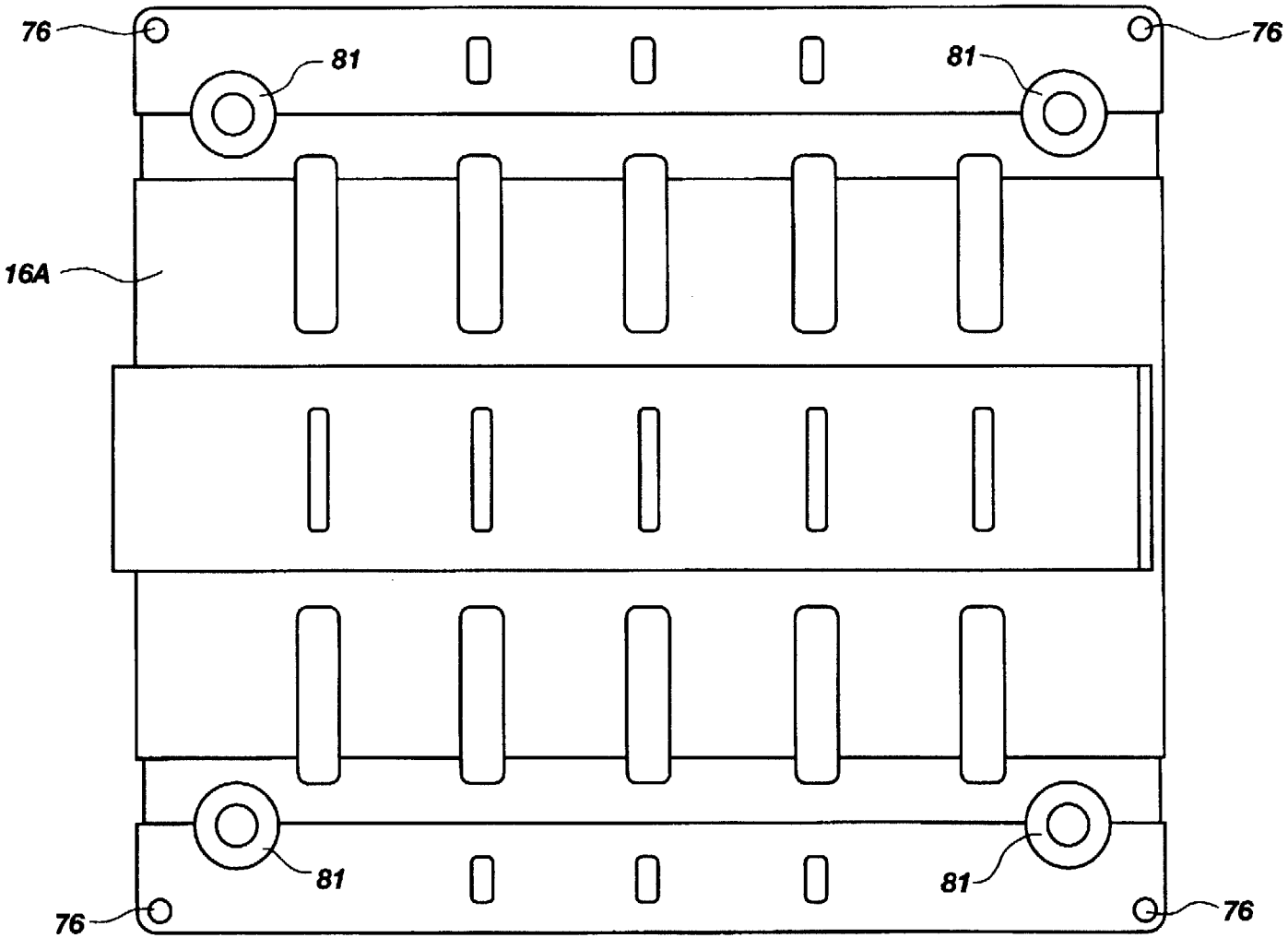
FIG. 24 is a plan view of the bottom surface of the floor of the container of FIG. 11.
Figure 25:
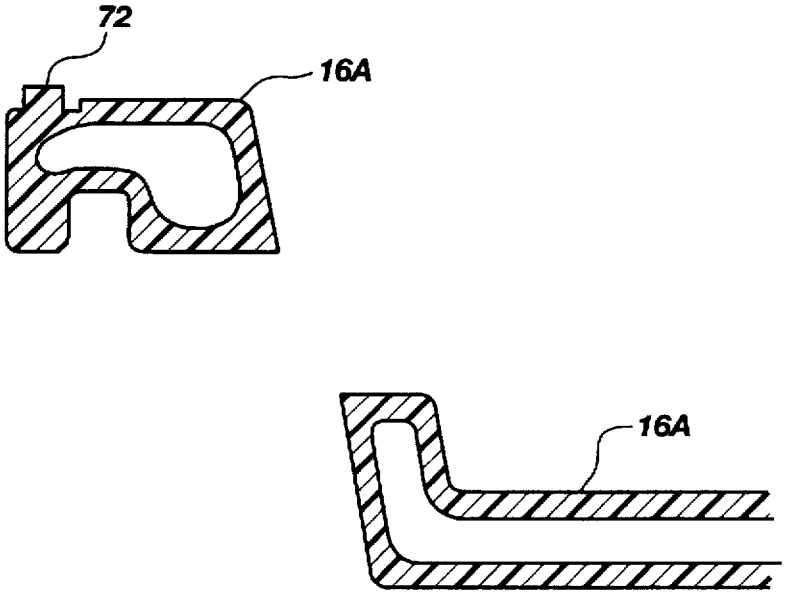
FIG. 25 is a cross sectional view of the floor of the container of FIG. 11 taken along sectional lines 25—25.
Figure 26:
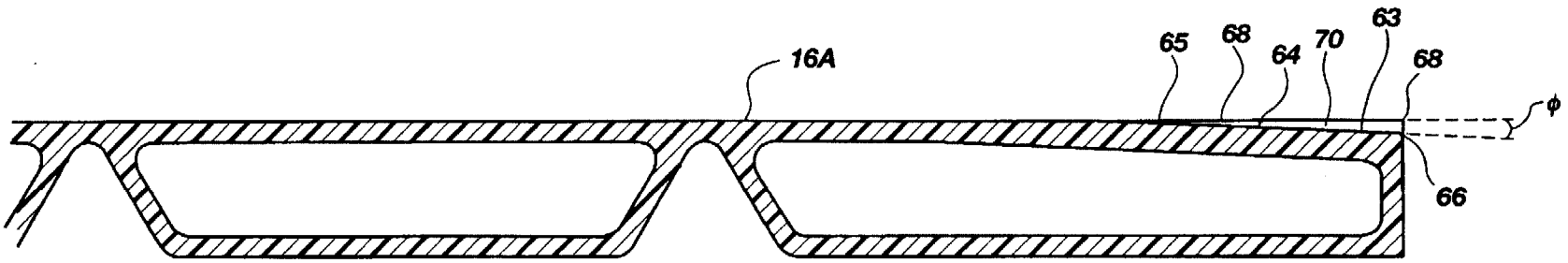
FIG. 26 is a cross sectional view of the floor of the container of FIG. 11 taken along section lines 26—26.
Figure 27:
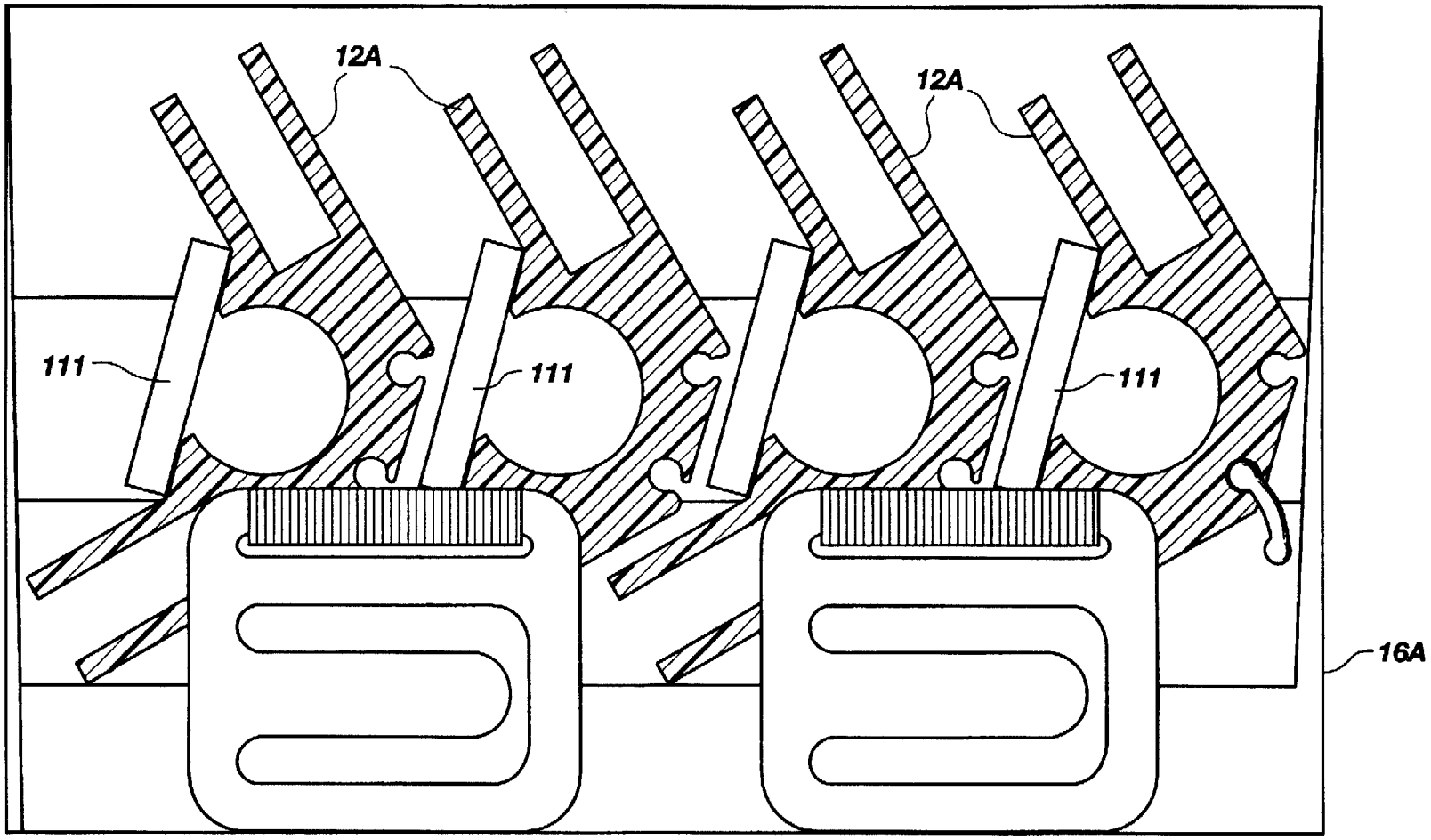
FIG. 27 is a partial side view of the storage channel of the floor of the container of FIG. 11, having a plurality of structural elements stored therein.

FIGS. 11–13 illustrate an alternative embodiment of the container of the invention. As shown a container is formed by a floor 16A which defines three channels 46A in the upper surface thereof. The structural features of the floor 16A are shown in greater detail in FIGS. 22 and 24. As shown in FIG. 23 the floor 16A includes a central channel 59 which is dimensioned to receive and retain the frame elements 12A. The frame elements are shown in a stored condition in this channel in FIG. 23. As shown, a portion of the floor element 16 may be configured to provide a view window 77 whereby the user may look into the channel 59 to verify the contents of that channel.

The floor 16A may be configured to define four slip ramps 62 in the surface of the floor 16. These ramps are adapted to permit the user to insert the tines of a fork lift under a load which is resting on the floor element 16A. As shown each ramp 62 is formed by a channel having a planar panel 64. The panel 64 forms the bottom surface of the channel. The first end 66 of the channel 63 is positioned elevationally lower than the edge 68 of the floor 16A. The panel 64 is positively inclined toward the center of the floor 16 whereby the opposing end of the channel 63 merges with the plane of the upper surface 79 of the floor 16A. The sidewalls 70 of the channel 63 extend vertically upright. The channels 63 form ramps to facilitate the unloading of cargo from the container by means of the forks of a conventional forklift.

Positioned at each of the corners of the floor 16A is a respective D-ring securement 81 which may be utilized to secure the container in a given location.

In this construction, the sidewalls 14A may be interconnected to the floor by means of a water seal 88 of the construction shown in FIG. 23. This particular water seal is positioned on the bottom edge of the sidewall. The water seal then interconnects with the floor to form a water proof seal. The seal 88 defines a first recess well 91 which is configured to receive and retain a sidewall 14A. The seal also defines a second recess well 93 which is configured to receive and retain a flange 72 of the floor element 16A. The floor 16A defines a plurality of upstanding flanges 72 positioned about the perimeter of the floor. These flanges 72 are configured to receive the water seal elements thereon. The seals 88 may be fabricated from an elastic material such as rubber.

Figure 16:
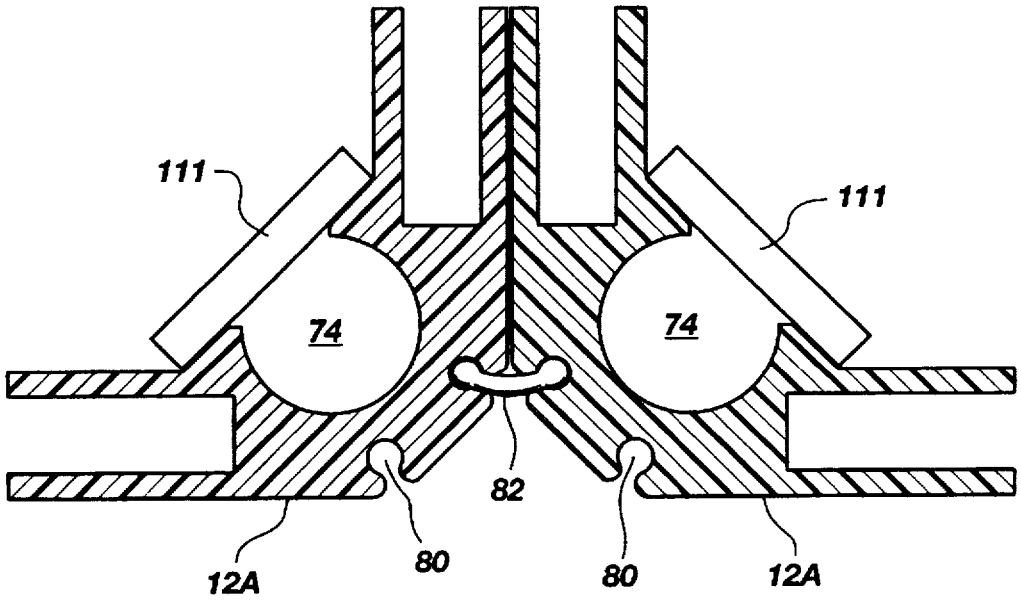
FIG. 16 is a top view of two frame elements interconnected to one another by an elongate joining strip.
Figure 17:
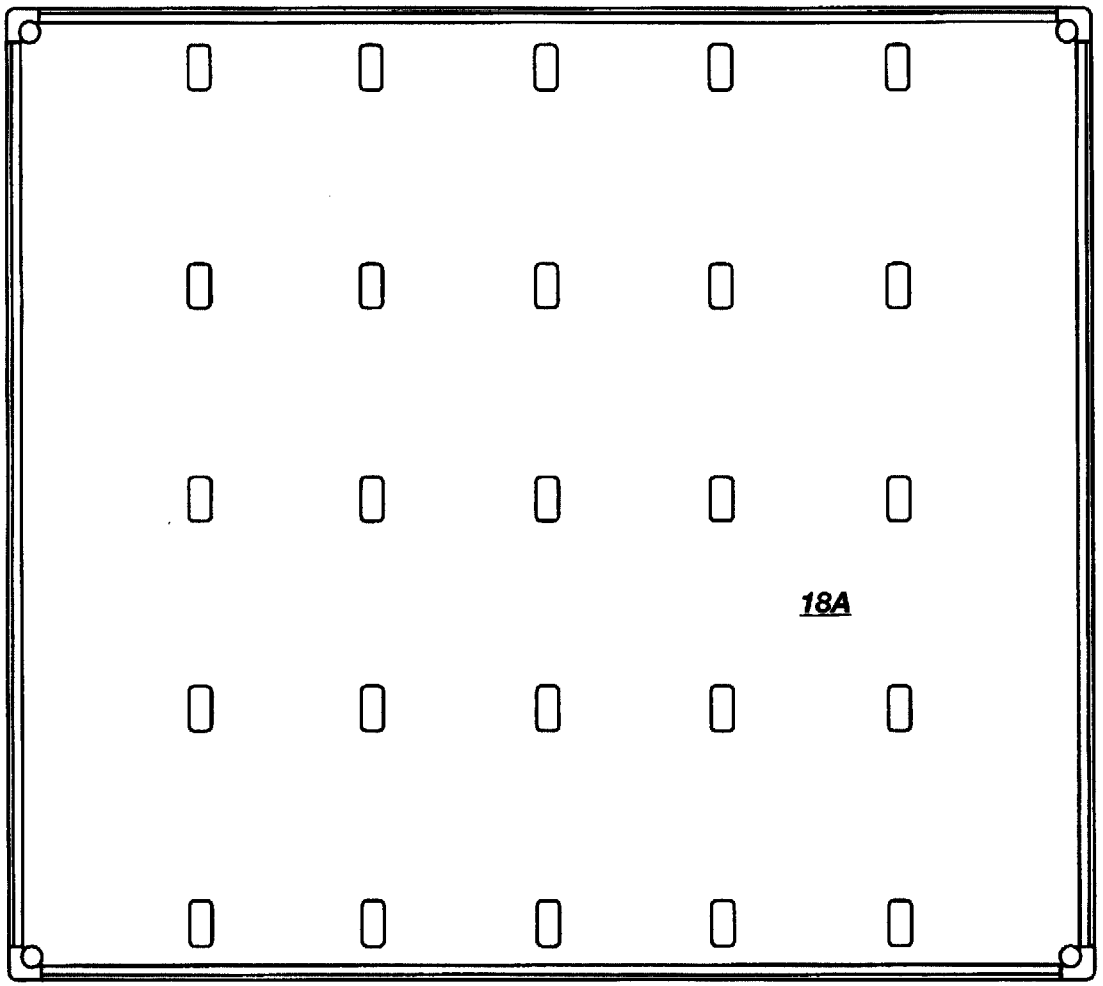
FIG. 17 is a plan view of the bottom surface of the cover of a container of the invention.
Figure 20:
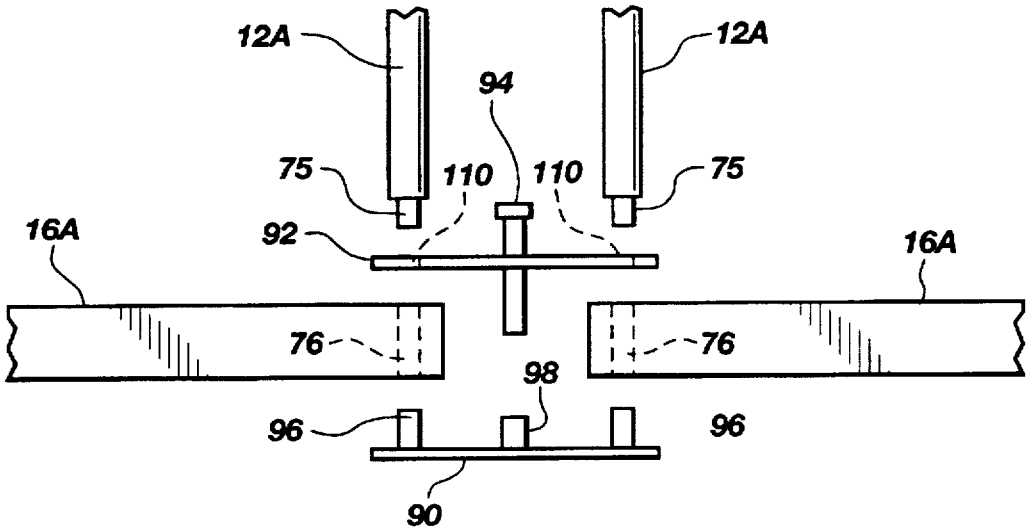
FIG. 20 is a partial exploded side view of the stiffener plate assembly in association with two floor elements.

Positioned atop the floor 16A are four frame elements 12A. Each of these frame elements is an elongate member, e.g. an extruded member, having a cross sectional profile as shown in FIG. 16. This particular cross section may extend over essentially the complete length of the frame member. As indicated the frame member 12A defines a generally circular cross sectioned opening 74 therein which extends through the length of the frame member. The frame member 12A also defines two recess channels 95 which are each configured to receive and retain a wall panel 14A. In the lower end of the frame member, the opening 74 may be filled by a male extension member 75 as shown in FIG. 20. This male member extends beyond the elongate member of the frame member to form a means of interconnecting the frame member with the floor 16A or alternatively to another frame member 12A. This male extension is specifically configured to be detachably received and retained within a respective recess well 76 defined within the structure of the floor 16A. The opposing end of the frame member 12A is not fitted with such a male extension. Instead, the opening 74 remains open. The described construction yields a frame member which may be easily joined with one or more other frame members to form a frame member of any desired height.

The cover 18A is fitted with a male extension member 78 proximate each of its corners. This male extension member 78 is dimensioned to be detachably received and retained within a respective opening 74 of a frame member 12A positioned thereunder.

In those constructions which position two frame elements side by side to achieve a predetermined construction, the adjacently positioned frame elements 12A may be interconnected to one another to form a more secure arrangement. To this end, each of the frame elements 12A defines an elongate generally circular shaped channel 80 which extends along the length of the frame member. A connection strip 82 having a length which may correspond to the length of the frame member 12A and having a cross section of the type illustrated in FIG. 16 is inserted into the corresponding channels 80 of the adjacently positioned frame members 12A. The strip 82 is preferably fabricated from nylon or similar material which provides a structurally strong member which also is self lubricating. The connection strip 82 serves to interlock the two frame elements and may also function as a water seal.

FIG. 16 illustrates a frame member 12A which includes a reinforcement member 111. This member includes a reinforcement member 111. This member which may be a planar strip welded to the body of the frame member 12A, may be used as a means of securing a tie strip for securing freight as well as reinforcing member 12A.

Figure 18:
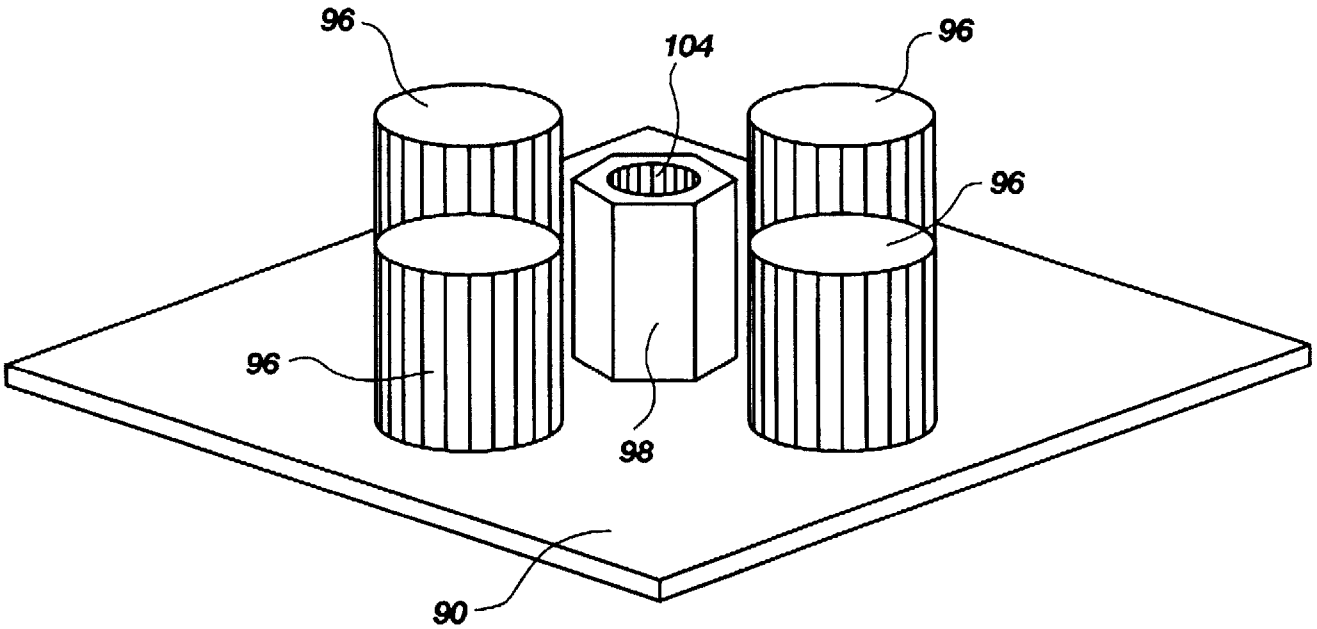
FIG. 18 is a perspective view of a stiffener plate used to interconnect two or more containers.
Figure 19:
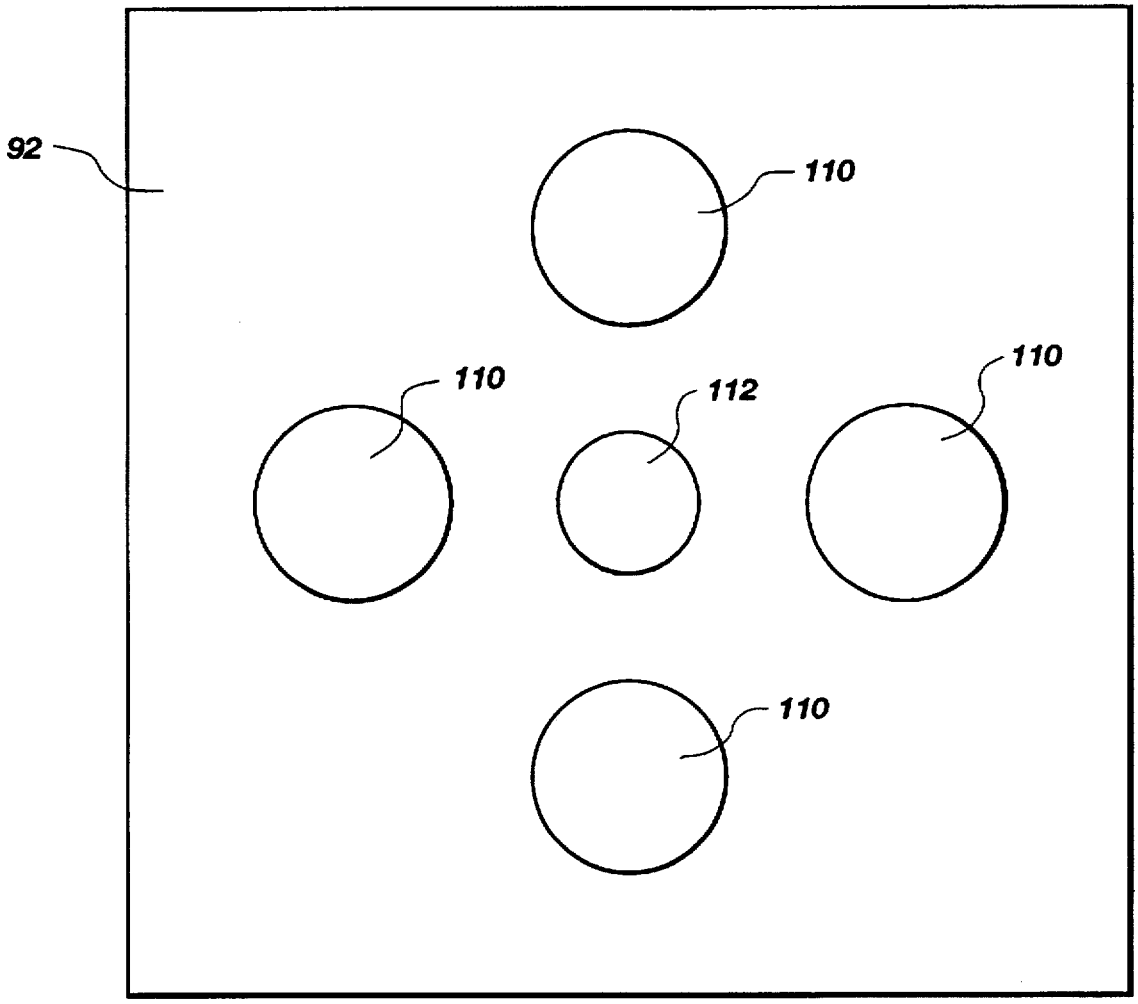
FIG. 19 is a top plan view of a connection plate adapted for use with the stiffener plate of FIG. 18.
Figure 21:
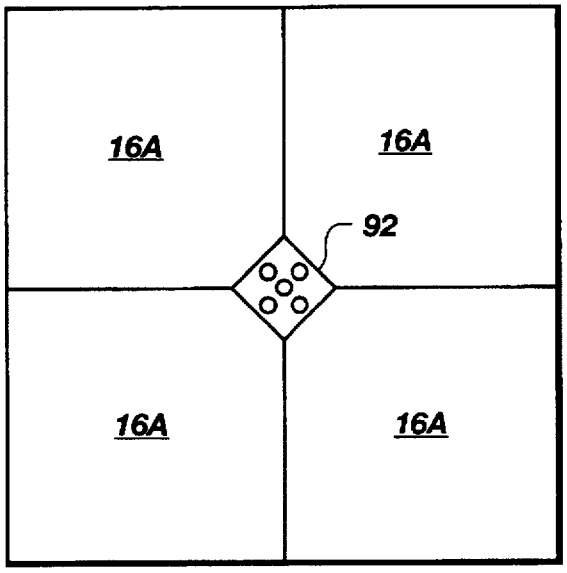
FIG. 21 is a top plan view of the stiffener plate assembly in position with four floor elements.

FIGS. 18–21 illustrate a means for stabilizing a plurality of floor elements or a plurality of containers. The Figures illustrate a stiffener assembly formed by a stiffener plate 90 in association with a connection plate 92 and a bolt 94. As shown in FIG. 18 the stiffener plate 90 includes a flat planar panel 95 having positioned thereon four upstanding cylindrical members 96 spacedly positioned from one another about a centrally positioned upstanding hexagonally shaped member 98. Each of the members 96 is dimensioned to be received within a respective recess well 76 defined in a floor element 16. It should be understood that the recess well 76 extends through the entire height of the floor element 16. Likewise, the members 96 are positioned on the panel member 102 such that when four floor panels 16 are positioned in abutment against one another as shown in FIG. 21, and the stiffener plate 90 is positioned under the floor elements, the members 96 are aligned to be each received into a respective recess well defined in a respective floor element. The hexagonally shaped member 98 defines a vertically upstanding female threaded channel 104 therein. The channel 104 is configured to threadly receive the male threaded bolt 94.

The connection plate 92 is formed by a generally square planar panel member 108 which defines four circular apertures 110 therein. Each of these apertures is dimensioned to permit the passage therethrough of the extension 75 of a frame member 12. Furthermore, the apertures 110 are arranged such that when the floor elements 16 are positioned in abutment against one another as shown in FIG. 21 and the connection plate is positioned atop the floor elements, each of the apertures 110 is aligned with a respective recess well 76 in a respective floor element 16. The connection plate 92 also defines a centrally positioned aperture 112 which is dimensioned to receive the male threaded bolt 94.

As shown in FIG. 20, the stiffener plate 90 is positioned below the assembly of floor elements such that the elements 96 are each inserted into a respective recess well 76 of a respective floor element. The connection plate 92 is then placed over the floor elements to align each of the apertures 110 over a respective recess well 76. The bolt 94 may then inserted through the aperture 112 of the connection plate 92 and is threadly inserted into the channel 104 until the plates 90 and 92 are brought into compression against the floor elements 16 sandwiched therebetween. The frame elements 12A may then be installed by passing their male extensions 75 each through a respective aperture 110 defined in the connection plate. The male extensions 75 are then received into a respective recess well 76. While the stiffener plate assembly is illustrated in the context of a means of supporting a floor assembly, it should be understood that this particular use is but one of several environments wherein such a stiffener assembly may be used. This assembly may also be used in association with a plurality of cover elements to form a cover assembly.

As can be noted from the attached figures, the instant invention provides a means whereby the user may construct a container specifically configured to receive and retain the articles to be shipped. The invention thereby provides a means whereby odd shaped articles may be packed within a transport trailer one on top of the other while minimizing the fear or concern as to damage which may result from otherwise placing articles which are simply loaded on a pallet and then placed subsequently one on top of another. Since each of the containers may be essentially sealed and if needed be locked, the shipper is given a measure of security as to the articles being transported. The shipper is able to load the container and seal the container. The container then remains sealed until it is delivered at its final destination. The instant container construction thereby lessens the concern as to a subsequent loss of one or more of the articles being shipped as the transport truck is loaded and unloaded at various intermediate destinations.

Those skilled in the art will recognize the embodiments here and before discussed are illustrative of the general principles of the invention. The embodiments herein described are not intended to limit the scope of the claims which themselves recite what applicant regards as his invention.

What is claimed is:

1. A container for use in transporting cargo, said container comprising:

a floor;

a cover;

a plurality of upstanding frame elements positioned on said floor, said plurality of upstanding frame elements including a first frame element and a second frame element positioned contiguous to one another, said first frame element and said second frame element each defining a channel therein;

a plurality of panel members, each of said panel members being mechanically associated with two of said frame elements; each of said frame elements having a first end and a second end, said first frame element and said second frame element each including means for receiving and retaining two of said panel members;

a water seal means for interconnecting said first frame element and said second frame element, said water seal means comprising an elongate strip detachably received in said channel defined in said first frame element and said second frame element, said elongate strip being configured to be slid into said channel of each of said first and second frame elements;

floor interconnection means for detachably interconnecting said first end of each of said frame elements to said floor;

cover interconnection means for detachably interconnecting said second end of each of said frame elements to said cover;

said cover being positioned on said frame elements;

said floor, frame members, panel members and cover forming an enclosure about an interior configured to receive and store cargo; and compression means for urging said floor toward said cover wherein said floor and said cover are urged into abutment against said frame members.

2. The container of claim 1 wherein said means for receiving and retaining two of said panel members, includes a first slot and a second slot defined in said frame member, each said slot being configured to receive and retain a respective said panel member.

3. The container of claim 2 wherein each of said slots defines an axis coinciding with a direction of insertion of a panel member into said slot, wherein said axis of said first slot is oriented ninety degrees from said axis of said second slot.

* * * * *